US012383949B2

(12) United States Patent
Uenishi et al.

(10) Patent No.: US 12,383,949 B2
(45) Date of Patent: Aug. 12, 2025

(54) HOT PRESS LINE AND METHOD OF MANUFACTURING HOT-PRESS-FORMED PRODUCT

(71) Applicant: NIPPON STEEL CORPORATION, Tokyo (JP)

(72) Inventors: Kenta Uenishi, Tokyo (JP); Toshiya Suzuki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 178 days.

(21) Appl. No.: 17/916,090

(22) PCT Filed: Mar. 30, 2021

(86) PCT No.: PCT/JP2021/013549
§ 371 (c)(1),
(2) Date: Sep. 30, 2022

(87) PCT Pub. No.: WO2021/200951
PCT Pub. Date: Oct. 7, 2021

(65) Prior Publication Data

US 2023/0158560 A1 May 25, 2023

(30) Foreign Application Priority Data

Apr. 3, 2020 (JP) ..... 2020-067816

(51) Int. Cl.
*B21D 22/20* (2006.01)
*B21D 24/00* (2006.01)
(Continued)

(52) U.S. Cl.
CPC ..... *B21D 22/208* (2013.01); *B21D 24/005* (2013.01); *B21D 37/10* (2013.01); *B21D 43/05* (2013.01)

(58) Field of Classification Search
CPC .... B21D 22/208; B21D 24/005; B21D 24/00; B21D 37/10; B21D 43/05; C21D 7/13; C21D 1/673; C21D 1/18
See application file for complete search history.

(56) References Cited

U.S. PATENT DOCUMENTS 8,980,020 B2 3/2015 Sikora et al.
9,127,330 B2 9/2015 Krispinsson
(Continued)

FOREIGN PATENT DOCUMENTS

JP 2007-237204 A 9/2007
JP 2015-226936 A 12/2015
(Continued)

*Primary Examiner* — Mohammed S. Alawadi
(74) *Attorney, Agent, or Firm* — Birch, Stewart, Kolasch & Birch, LLP

(57) ABSTRACT

A hot press line (100) includes: a heating device (30); a first press device (10) having first die parts (1A, 1B); a second press device (20) having second die parts (2A, 2B); a first transportation device (41) that transports a metal sheet (B) to the first press device; and a second transportation device (42) that transports the metal sheet (B) to the second press device. One of the pair of first die parts and the pair of second die parts includes a clearance portion (1Ac) recessed inwardly, whereas the other pair of die parts includes an abutment surface (2At) in at least part of the portion corresponding to the clearance portion (1Ac) of the one pair of die parts, where the abutment surface abuts the metal sheet (B) when the die is at the bottom-dead center.

12 Claims, 17 Drawing Sheets

(51) Int. Cl.

| | |
|---|---|
| ***B21D 37/10*** | (2006.01) |
| ***B21D 43/05*** | (2006.01) |
| ***C21D 1/18*** | (2006.01) |
| ***C21D 1/673*** | (2006.01) |
| ***C21D 7/13*** | (2006.01) |

(56) References Cited

U.S. PATENT DOCUMENTS

| | | | | |
|---|---|---|---|---|
| 11,161,164 | B2 | 11/2021 | Serizawa et al. | |
| 2011/0094282 | A1* | 4/2011 | Overrath ..... | B21D 22/022 72/364 |
| 2012/0073708 | A1 | 3/2012 | Krispinsson | |
| 2012/0186705 | A1 | 7/2012 | Sikora et al. | |
| 2013/0025340 | A1 | 1/2013 | Kobayashi | |
| 2019/0099795 | A1 | 4/2019 | Dong | |
| 2021/0008609 | A1* | 1/2021 | Serizawa ..... | B21D 22/022 |

FOREIGN PATENT DOCUMENTS

| | | | |
|---|---|---|---|
| JP | 5864414 | B2 | 2/2016 |
| JP | 6664558 | B1 | 3/2020 |

* cited by examiner

HOT PRESS LINE AND METHOD OF MANUFACTURING HOT-PRESS-FORMED PRODUCT

TECHNICAL FIELD

The present invention relates to a hot press line and a method of manufacturing a hot-press-formed product.

BACKGROUND ART

In some metallic structural members, properties such as strength may be locally varied. For example, when a high-strength member is used as a vehicle-skeleton member, some low-strength portions may be provided in the member, rather than providing high strength to all the portions. There are several reasons for doing this. For example, machining such as drilling may be performed in low-strength portions. In other applications, the deformation behavior of a member may be controlled by providing low-strength portions that are to be deformed early during deformation of the member.

One method for manufacturing a member with low-strength portions involves welding steels with different properties to provide a tailor-welded blank, followed by hot working (i.e., hot stamping). For example, Japanese Patent No. 5864414 describes a method of hot press forming a steel sheet blank composed of separate sheets that have been welded together. In this method, a steel sheet blank is heated and then hot press formed inside a pair of cooled tools, and, while the blank is still inside the pair of tools, the formed product is hardened. The welded portions of the two sheets are cooled at lower cooling rates with respect to portions on both sides of each welded portion. This forms portions with low martensite contents along the welded portions. The cooling rate is lowered by keeping a gap between the pair of tools and the end product.

JP 2015-226936 A discloses a manufacturing method that enables local adjustment of the construction of a metal structure component. In this manufacturing method, a steel member is hot formed and then at least several sections are hardened through contact with the tool surface. At least one of two sections of the tool surface has a surface coating that decreases or increases thermal conductivity. Sections of the tool surface with different thermal conductivities lead to different cooling rates. The sub-regions of the steel member with different cooling rates have different microscopic structures after hardening.

PRIOR ART DOCUMENTS

Patent Documents

Patent Document 1: Japanese Patent No. 5864414
Patent Document 2: JP 2015-226936 A

SUMMARY OF THE INVENTION

Problems to be Solved by the Invention

The above-described conventional techniques achieve a local decrease in the cooling rate of a metal sheet by virtue of a gap (or clearance) between the formed product and the die, or a thermal-conductivity distribution in the die surface. However, when the formed product has been removed from the die, the temperatures in portions with lower cooling rates are still high. Then, as these portions experience thermal contraction during cooling, the formed product may develop defects of shape. Further, if there are large temperature differences within the formed product when the formed product is removed from the die, the formed product may deform due to thermal contraction, leading to defects of shape. To reduce the temperature of the formed product upon removal from the die as well as temperature differences within the formed product, the formed product must be kept in the die until a uniform temperature is reached inside the formed product. On the other hand, from the viewpoint of manufacture cost, for example, it is preferable to minimize the period of time for which the formed product is held in the die (i.e., bottom-dead-center holding period). That is, it is difficult to achieve both productivity and shape accuracy with conventional methods.

In view of this, the present disclosure provides a hot press line and a method of manufacturing a hot press-formed product that ensure the shape accuracy of a formed product provided with a property distribution without prolonging the bottom-dead-center holding time for the formed product in the die during hot pressing.

Means for Solving the Problems

A hot press line according to an embodiment of the present invention includes: a heating device adapted to heat a metal sheet; a first press device including a pair of first die parts movable relative to each other in a direction of pressing and adapted to press form the heated metal sheet by moving the first die parts closer to each other in the direction of pressing and, at a bottom-dead center, hold the metal sheet; a second press device including a pair of second die parts movable relative to each other in the direction of pressing and adapted, at a bottom-dead center of the second die parts, to hold the metal sheet press formed by the first press device; a first transportation device adapted to transport the metal sheet from the heating device to the first press device; and a second transportation device adapted to transport the metal sheet from the first press device to the second press device. At least one of the pair of first pairs and the pair of second die parts includes a clearance portion recessed inwardly to create a clearance with the metal sheet while the die parts are at the bottom-dead center, and the other pair of die parts includes an abutment surface located in at least part of a portion corresponding to the clearance portion of the one pair of die parts and adapted to abut the metal sheet while the die parts are at the bottom-dead center.

Effects of the Invention

The present disclosure ensures the shape accuracy of a formed product provided with a property distribution without prolonging the bottom-dead-center holding time for the formed product in the die during hot pressing.

Figure 1:
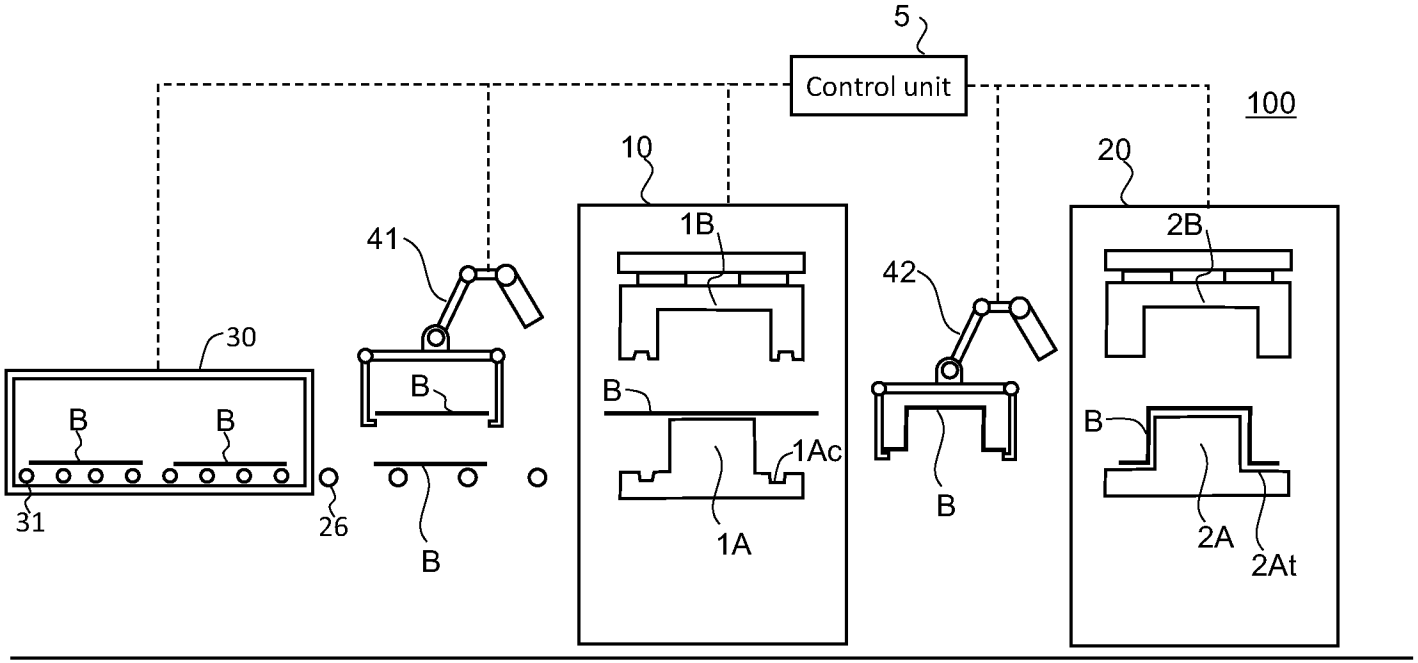
FIG. 1 shows an exemplary construction of a hot press line according to an embodiment.

EMBODIMENTS FOR CARRYING OUT THE INVENTION (Arrangement 1)

A hot press line according to an embodiment of the present invention includes: a heating device adapted to heat a metal sheet; a first press device including a pair of first die parts movable relative to each other in a direction of pressing and adapted to press form the heated metal sheet by moving the first die parts closer to each other in the direction of pressing and, at a bottom-dead center, hold the metal sheet; a second press device including a pair of second die parts movable relative to each other in the direction of pressing and adapted, at a bottom-dead center of the second die parts, to hold the metal sheet press formed by the first press device; a first transportation device adapted to transport the metal sheet from the heating device to the first press device; and a second transportation device adapted to transport the metal sheet from the first press device to the second press device. At least one of the pair of first die parts and the pair of second die parts includes a clearance portion recessed inwardly to create a clearance with the metal sheet while the die parts are at the bottom-dead center, and the other pair of die parts includes an abutment surface located in at least part of a portion corresponding to the clearance portion of the one pair of die parts and adapted to abut the metal sheet while the die parts are at the bottom-dead center.

In Arrangement 1 described above, the formed metal sheet is rapidly cooled in a bottom-dead-center holding period, which is represented by the sum of the period of time for which the first die parts of the first press device hold the metal sheet at their bottom-dead center and the period of time for which the second die parts of the second press device hold the metal sheet at their bottom-dead center. At least one of the pair of first die parts and the pair of second die parts includes a clearance portion, and the portion of the other pair of die parts corresponding to the clearance portion is provided with an abutment surface for abutting the metal sheet while the die is at the bottom-dead center. Thus, the bottom-dead-center holding period represented by the sum of the bottom-dead-center holding period for the first die parts and the bottom-dead-center holding period for the second die parts includes a non-abutment period for which some portions of the metal sheet are not in contact with a die due to the clearance portion, as well as an abutment period for which a die is in contact with those portions of the metal sheet. During the non-abutment period, cooling rate can be reduced, i.e. gradual cooling can be performed. Further, during the abutment period in the bottom-dead-center holding time for which a die abuts the above-mentioned portions of the metal sheet, cooling rate can be increased, i.e., rapid cooling can be performed. This will achieve a close-to-uniform temperature distribution of the metal sheet while a portion of the formed metal sheet corresponding to the clearance portion has different cooling conditions from those of portions with which a die is in contact throughout the bottom-dead-center holding period. This provides the formed metal sheet removed from the second die parts with a property distribution derived from the differences in cooling conditions and, at the same time, reduces a decrease in the shape accuracy of the formed product due to the temperature differences. This ensures the shape accuracy of a formed product provided with a property distribution without prolonging the bottom-dead-center holding time for the formed product in the die.

In conventional methods in which cooling rate is reduced by a clearance or by means of thermal conductivities of the die surface, the cooling conditions under which part of the member is gradually cooled are predetermined cooling conditions based on the construction of the die. Thus, the metal structure composition obtained by gradual cooling and the temperature distribution of the member as removed from the die also depend on the construction of the die. Changing these features requires adjusting the construction of the die or re-fabricating a die. In contrast, in Arrangement 1 described above, cooling conditions can easily be adjusted by changing press conditions or transportation conditions. For example, the cooling conditions can be controlled by adjusting the lengths of the time for which the first die parts hold the metal sheet at the bottom-dead center and the time for which the second die parts hold the metal sheet at the bottom-dead center. Thus, in a pressing process using a hot press line, the cooling conditions under which some portions of the formed metal sheet are gradually cooled can be easily changed.

The construction of the clearance-related portions of the first die parts and that for the second die parts are different from each other. A clearance portion is provided in at least one of the pair of first die parts and the second die parts. The geometry of the pair of surfaces of the pair of first die parts that face each other in the direction of pressing (i.e., forming surfaces) and the geometry of the pair of surfaces of the pair of second die parts that face each other in the direction of pressing (i.e., forming surfaces) may be the same except for the clearance portion. Thus, the metal sheet formed by the first die parts can be held by the second die parts at the bottom-dead center while the portions of the metal sheet other than the portions corresponding to the clearance portion of the first die parts can maintain their shape. In some implementations, the second die parts may be constructed, at the bottom-dead center, to hold the metal sheet that has been press formed by the first die parts while maintaining the shape of the metal sheet.

(Arrangement 2)

Starting from Arrangement 1 described above, the first die parts may include the clearance portion, and the second die parts may include the abutment surface in at least part of a portion corresponding to the clearance portion of the first die parts. Thus, the second die parts can contact the metal sheet for rapid cooling in a sub-period of the bottom-dead-center holding period for the second die parts for which the temperature of the metal sheet is relatively low. This will make it easier to achieve a close-to-uniform temperature distribution of the metal sheet. That is, it will be easier to ensure the shape accuracy of the entire formed metal sheet. Further, it will be easier to adjust the cooling conditions by controlling the abutment period.

(Arrangement 3)

Starting from Arrangement 1 or 2 described above, the second die parts may include the clearance portion, and the first die parts may include the abutment surface in at least part of a portion corresponding to the clearance portion of the second die parts. Thus, the first die parts can form the metal sheet in a sub-period of the bottom-dead-center holding period for the first die for which the metal sheet has a relatively high temperature and easy to form. This will make it easier to ensure local shape accuracy, i.e., the shape accuracy of a portion of a formed metal sheet that corresponds to the clearance portion of the die.

(Arrangement 4)

Starting from any one of Arrangements 1 to 3 described above, the clearance portion of the one pair of die parts may include a pair of clearance portions facing each other with the metal sheet positioned therebetween. In such implementations, the abutment surface of the other pair of die parts may include a pair of abutment surfaces facing each other with the metal sheet positioned therebetween, the pair of abutment surfaces located in at least part of portions corresponding to the pair of clearance portions of the one pair of die parts. At the clearance portions of the one pair of die parts, clearances are present on both sides of the metal sheet when the die is at the bottom-dead center, and, in the other pair of die parts, both sides of the metal sheet abut the die at the bottom-dead center. This will increase the robustness of the cooling conditions.

(Arrangement 5)

Starting from any one of Arrangements 1 to 4 described above, the abutment surface of the other pair of die parts includes a pair of abutment surfaces facing each other in the direction of pressing, and the pair of abutment surfaces are shaped to bend the metal sheet in the direction of pressing. This will enable forming the portion of the metal sheet corresponding to the clearance portion of the one pair of die parts to a shape corresponding to the pair of abutment surfaces of the other pair of die parts.

For example, one of the abutment surfaces of the other pair of die parts may have a recess or protrusion recessed or protruding in the direction of pressing. In such implementations, the other abutment surface facing the one abutment surface may have a shape corresponding to the recess or protrusion of the one abutment surface.

Starting from any one of Arrangements 1 to 4, the abutment surface of the other pair of die parts corresponding to the clearance portion of the one pair of die parts may be a flat surface. Thus, a flat-surface portion of the formed metal sheet is provided with a property distribution.

(Arrangement 6)

Starting from any one of Arrangements 1 to 5 described above, a die portion of the one pair of die parts facing the clearance portion of the one pair may be provided with the abutment surface for abutting the metal sheet when the die parts are at the bottom-dead center, and a die portion of the other pair of die parts facing the abutment surface of the other pair may be provided with the clearance portion recessed inwardly for creating a clearance with the metal sheet when the die parts at the bottom-dead center.

The area of the clearance portion in the one pair of dies is preferably not larger than a half of the area that abuts the metal sheet when the die is at the bottom-dead center, more preferably not larger than 30%, and yet more preferably not larger than 20%. An excessively high proportion of the clearance portion reduces the proportion of the area that grips the formed metal sheet when the die is at the bottom-dead center, making it difficult to achieve high shape accuracy.

The edge of the recess forming the clearance portion in the one pair of die parts may be surrounded by the pressing surface of the die. The pressing surface is the surface of the die that abuts the metal sheet when the die is at the bottom-dead center. That is, the clearance portion may be located in a region surrounded by the surface that abuts and presses the metal sheet B when the die is at the bottom-dead center. Thus, when the die is at the bottom-dead center, the portions of the formed metal sheet B surrounding the clearance portion are gripped by the die. This makes it easier to ensure the shape accuracy of the formed metal sheet B.

The second transportation device preferably transports the metal sheet such that the period of time from the point at which the metal sheet is removed from the first die parts to the point at which the metal sheet is positioned at the second die parts is not longer than 30 seconds, more preferably not longer than 15 seconds, and yet more preferably not longer than 10 seconds. This will reduce the time from the end of bottom-dead-center holding by the first die parts to the beginning of bottom-dead-center holding by the second die parts, thereby reducing a temperature decrease in this time.

Starting from any one of Arrangements 1 to 6 described above, the first press device and the second press device may include a cooling mechanism adapted to cool the first die parts and the second die parts. For example, at least one of the pair of first die parts and the pair of second die parts may include a tube or a groove for allowing a cooling medium to pass therethrough.

Starting from any one of Arrangements 1 to 6 described above, the hot press line may include a control unit adapted to control the first press device and the second press device. The control unit is capable of controlling, for example, a holding time for the metal sheet by the first die parts in the first press device at the bottom-dead center, and a holding time for the metal sheet by the second die parts in the second press device at the bottom-dead center. This enables adjusting the non-abutment period and abutment period in the entire bottom-dead-center holding period. That is, the cooling conditions for a portion of the metal sheet corresponding to the clearance portion can be adjusted.

For example, the control unit may control the first die parts and the second die parts such that the abutment period accounts for 20 to 90% of the entire bottom-dead-center holding period. In such implementations, the abutment period is preferably not longer than 70% of the entire bottom-dead-center holding period, and more preferably not longer than 50%.

(Manufacturing Method 1)

A method of manufacturing a hot press-formed product according to an embodiment of the present invention includes: heating a metal sheet; positioning the heated metal sheet between a pair of first die parts of a first press device;

press forming the metal sheet by moving the first die parts closer to each other in a direction of pressing; a first bottom-dead-center holding step for holding the metal sheet while the pair of first die parts are at a bottom-dead center; after the first bottom-dead-center holding step, transporting the press-formed metal sheet to a pair of second die parts of a second press device and positioning the metal sheet therebetween; and a second bottom-dead center holding step for holding the metal sheet press formed by the first press device while the pair of second die parts are at a bottom-dead center. During one of the first bottom-dead-center holding step and the second bottom-dead-center holding step, a surface of the metal sheet has a non-abutment region that does not contact a die at a bottom-dead center, and at least part of the non-abutment region contacts a die at a bottom-dead center during the other bottom-dead-center holding step.

In the Manufacturing Method 1 described above, the bottom-dead-center holding period represented by the sum of the times of the first and second bottom-dead-center holding steps includes a non-abutment period for which the non-abutment region of the surface of the metal sheet does not abut a die at its bottom-dead center, as well as an abutment period for which that surface abuts a die at its bottom-dead center. Cooling rate can be reduced during the non-abutment period of the bottom-dead-center holding period. Further, cooling rate can be increased during the abutment period of the bottom-dead-center holding period. This will achieve a close-to-uniform temperature distribution of the metal sheet while the non-abutment region of the formed metal sheet has different cooling conditions from those of the other portions. This ensures the shape accuracy of a formed product provided with a property distribution without prolonging the bottom-dead-center holding time for the formed product in the die.

(Manufacturing Method 2)

Starting from Manufacturing Method 1 described above, at least part of the non-abutment region of the metal sheet for the first bottom-dead-center holding step may abut at least one of the pair of the second parts die during the second bottom-dead-center holding step. Thus, in the entire bottom-dead-center holding period represented by the sum of the times of the first and second bottom-dead-center holding steps, the die may be in contact with the metal sheet for rapid cooling for a sub-period for which the temperature of the metal sheet is relatively low. This will make it easier to ensure the shape accuracy of the entire formed metal sheet. Further, it will be easier to adjust the cooling conditions by controlling the abutment period.

(Manufacturing Method 3)

Starting from Manufacturing Method 1 or 2 described above, at least part of the non-abutment region of the metal sheet for the second bottom-dead-center holding step may abut at least one of the pair of first die parts during the first bottom-dead-center holding step. Thus, in the entire bottom-dead-center holding period, the die may be in contact with the metal sheet for rapid cooling for a sub-period for which the temperature of the metal sheet is relatively high. This will make it easier to ensure local shape accuracy, i.e., the shape accuracy of a portion of a formed metal sheet that corresponds to the clearance portion.

(Manufacturing Method 4)

Starting from Manufacturing Method 1 or 2 described above, the non-abutment region of the metal sheet during the one bottom-dead-center holding step may include a pair of regions, facing each other, of both sides of the metal sheet, and at least part of each region of the pair of regions of the non-abutment region may contact a die part at the bottom-dead center during the other bottom-dead-center holding step. This increases the robustness of the cooling conditions.

(Manufacturing Method 5)

Starting from any one of Manufacturing Methods 1 to 4 described above, during the other bottom-dead-center holding step, at least part of the non-abutment region of the metal sheet for the one bottom-dead-center holding step may contact a die part at the bottom-dead center and may be formed to bend in the direction of pressing.

(Manufacturing Method 6)

Starting from any one of Manufacturing Methods 1 to 5 described above, during the one bottom-dead-center holding step, at least part of a back side region of the metal sheet for the non-abutment region may be abutted by a die part at the bottom-dead center and, during the other bottom-dead-center holding step, at least part of the back side region for the non-abutment region may not be abutted by a die part.

Now, embodiments of the present invention will be described in detail with reference to the drawings. The same or corresponding elements in the drawings are labeled with the same reference characters and their description will not be repeated. For ease of explanation, the drawings to which reference will be made below show components in a simplified or schematic manner, or omit some components.

Exemplary Construction of Hot Press Line

FIG. 1 shows an exemplary construction of a hot press line according to an embodiment. The hot press line 100 includes a heating device 30, a first transportation device 41, a first press device 10, a second transportation device 42, a second press device 20, and a control unit 5.

The heating device 30 heats an object to be heated. The heating device 30 may be, for example, a gas heating furnace, a far-infrared heating furnace or a near-infrared heating furnace. The heating device 30 is not limited to a heating furnace, and may be, for example, a high-frequency induction heater, a low-frequency induction heater, or an electrical heater that heats the object to be heated by passing electricity therethrough. The heating device 30 may include a heating chamber. The heating device 30 may include, inside the heating chamber, a plurality of in-chamber rollers 31 that are driven by a driving mechanism, not shown, to rotate. As the in-chamber rollers 31 are rotated, the object to be heated on the in-chamber rollers 31 (in the present implementation, metal sheet B to be pressed) is transported. Next to the heating device 30 are positioned a transportation rollers 26. The metal sheet B heated by the heating device 30 is transported by the transportation rollers 26 out of the heating device 30.

The first transportation device 41 transports the metal sheet B from the heating device 30 to the first press device 10. The first transportation device 41 may be a manipulator, for example. Operations by the first transportation device 41 include lifting, holding and transporting, and putting of the metal sheet B. The first transportation device 41 is not limited to a manipulator. The first transportation device 41 may be, for example, a forklift or a roller conveyor.

The first press device 10 includes a pair of first die parts 1A and 1B movable relative to each other in the direction of pressing. The first transportation device 41 places the metal sheet B between the first die parts 1A and 1B of the first press device 10. The first press device 10 press forms the heated metal sheet B by moving the first die parts 1A and 2A closer to each other in the direction of pressing and holds the sheet between the die parts at the bottom-dead center.

The second transportation device 42 transports the metal sheet B from the first press device 10 to the second press device 20. Similar to the first transportation device 41, the second transportation device 42 may be constituted by a manipulator, a forklift, or a roller conveyor.

The second press device 20 includes a pair of second die parts 2A and 2*b* movable relative to each other in the direction of pressing. The second transportation device 42 places, between the second die parts 2A and 2, the metal sheet B that has been press formed by the first press device 10. The second press device 20 holds, between the second die parts 2A and 2B at the bottom-dead center, the metal sheet B that has been press formed by the first press device 10.

At least one of the pair of first die parts 1A and 1B and the pair of second die parts 2A and 2B includes a clearance portion 1Ac. In the implementation shown in FIG. 1, the pair of first die parts 1A and 1B includes a clearance portion. A clearance portion is provided in at least one of the two surfaces of the pair of die parts that face each other in the direction of pressing. A clearance portion is a recess in a die part, recessed inwardly. With one pair of die parts (i.e., first die parts 1A and 1B in the implementation of FIG. 1) including a clearance portion, the other pair of die parts (i.e., second die parts 2A and 2B in the implementation of FIG. 1) includes an abutment surface 2At. The abutment surface 2At is constituted by at least part of the portion of a surface of the other pair of die parts that corresponds to the clearance portion of the one pair of die parts. The abutment surface 2At abuts the metal sheet when the die is at the bottom-dead center. Thus, the first die parts 1A and 1B are different from the second die parts 2A and 2B in the construction of the clearance-related portions. Except for the clearance-related portions, the forming surfaces of the first die parts 1A and 1B have the same constructions as the forming surfaces of the second die parts 2A and 2B.

The implementation shown in FIG. 1 is an exemplary implementation where the one pair of die parts with a clearance portion is constituted by the pair of first die parts 1A and 1B while the other pair of die parts is constituted by the pair of second die parts 2A and 2B. In other implementations, conversely, the pair of second die parts 2A and 2B may constitute the one pair of die parts with a clearance portion while the pair of first die parts 1A and 1B may constitute the other pair of die parts with an abutment surface.

The control unit 5 controls the hot press line 100. The control unit 5 may be configured to control at least one of the heating device 30, first transportation device 41, first press device 10, second transportation device 42 and second press device 20. The control unit 5 may be constituted by one or more computers including a processor and memory.

The processor of the control unit 5 executes a program stored on the memory to implement the function of supplying control information to at least one of the heating device 30, first transportation device 41, first press device 10, second transportation device 42 and second press device 20 (i.e., device to be controlled). By way of example, based on input from the outside and/or data stored in advance on the memory, the control unit 5 decides on times where the device to be controlled is operated and amounts of operation (or directions of operation), and determines the control information necessary for the relevant movements. The control unit 5 outputs the control information to the device to be controlled.

In the hot press line 100, the metal sheet B heated by the heating device 30 is press formed by the first press device 10 and held by the first die parts 1A and 1B at the bottom-dead center. Thus, the metal sheet B, while maintaining the shape resulting from the press forming, is gripped by the die parts and rapidly cooled. The portions of the surfaces of the metal sheet B that correspond to the clearance portion 1Ac of the first die parts 1A and 1B at the bottom-dead center provide a non-abutment region that does not contact the die. The non-abutment region of the metal sheet B is gradually cooled. The non-abutment region has different cooling conditions from those of the other regions. In the second press device 20, the metal sheet B that has been press formed by the first press device 10 is held between the second die parts 2A and 2B at the bottom-dead center. Thus, the formed metal sheet B is gripped by the second die parts 2A and 2B and cooled rapidly. At this time, the second die parts 2A and 2B abut at least part of the non-abutment region, too. This rapidly cools the non-abutment region. The formed metal sheet B is cooled and quenched for the sum of the bottom-dead-center holding period of the first die parts 1A and 1B and the bottom-dead-center holding period of the second die parts 2A and 2B, i.e., the total bottom-dead-center holding period.

In the implementation shown in FIG. 1, the pair of first die parts 1A and 1B of the first press device 10, on the one hand, and the pair of second die parts 2A and 2B of the second press device, on the other hand, are configured to operate independently from each other. More specifically, the first press device 10 includes a pair of supports (e.g., slides and bolsters, not shown) that support the respective first die parts 1A and 1B, and an actuator (not shown) that moves at least one of these supports in the direction of pressing. The second press device 20, independently from the first press device 10, includes a pair of supports that support the respective second die parts 2A and 2B and an actuator that moves at least one of these supports.

The first and second press devices 10 and 20 are not limited to this arrangement. For example, the first die parts 1A and 1B and the second die parts 2A and 2B may share supports. More specifically, it is possible to provide a common support (for example, slider) that supports one first die part 1A and one second die part 2A, a common support (for example, bolster) that supports the other first die part 1B and the other second die part 2B, and a common actuator that moves at least one of these supports. In such implementations, the first and second press devices 10 and 20 are constructed to share supports and an actuator. By way of example, the first and second press devices 10 and 20 may be constituted by a single press device that performs transfer pressing with first die parts 1A and 1B and second die parts 2A and 2B.

Exemplary Construction of First Press Device

Figure 2:
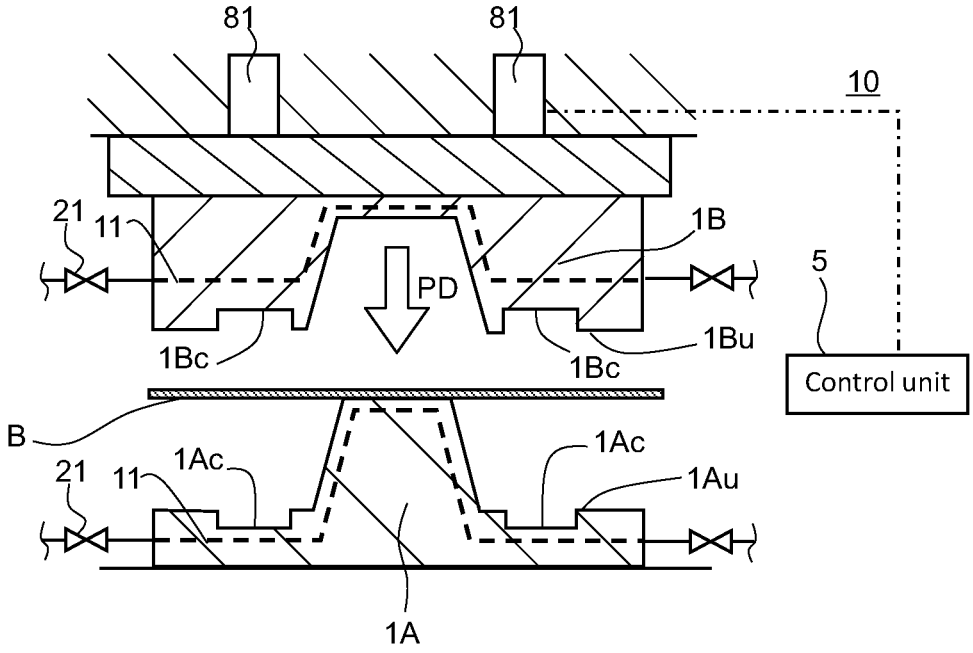
FIG. 2 is a cross-sectional view of a first press device according to an embodiment, illustrating its construction.
Figure 3:
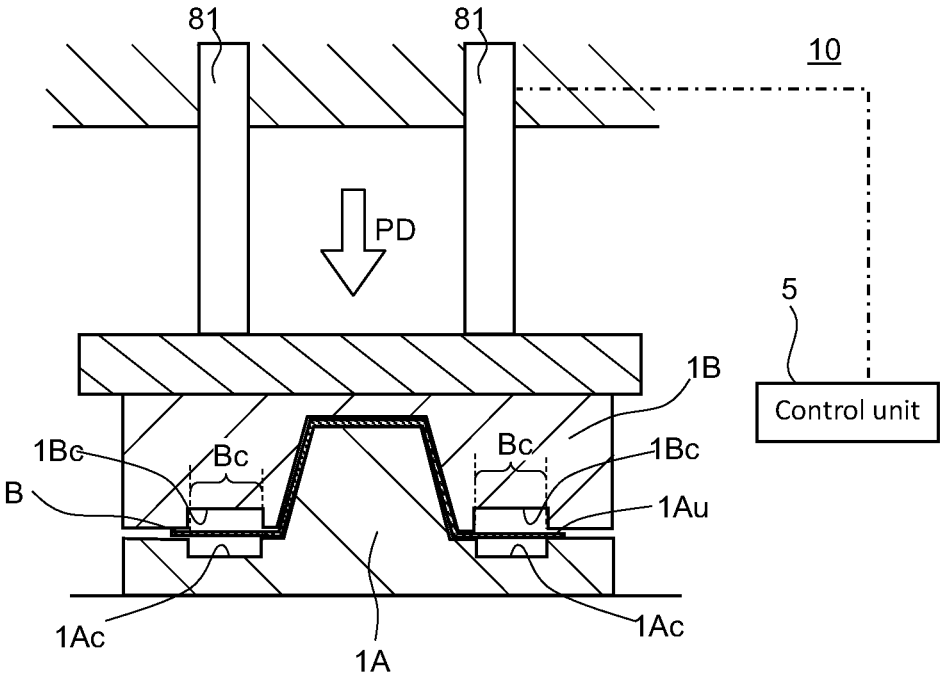
FIG. 3 illustrates the first press device shown in FIG. 2 as being at its bottom-dead center.

FIG. 2 is a cross-sectional view of the first press device 10 shown in FIG. 1, illustrating its construction. FIG. 3 illustrates the first press device 10 shown in FIG. 2 as being at its bottom-dead center. In the implementation shown in FIGS. 2 and 3, the first press device 10 includes a die block 1B and a punch 1A that exemplify the pair of first die parts 1A and 1B. The die block 1B is movable relative to the punch 1A in the direction of pressing PD. That is, the die block 1B and punch 1A are movable relative to each other. The directions of such relative movements are referred to as direction of pressing.

The die block 1B is movable by a lift mechanism (i.e., actuator) 81 in the direction of pressing relative to the punch 1A. The lift mechanism 81 may include, for example, a hydraulic cylinder, air cylinder, air cushion or cam. In the present implementation, the die block 1B moves relative to the punch 1A; in some arrangements, the punch 1A may move relative to the die block 1B. In other arrangements, both the die block 1B and punch 1A may move.

The control unit 5 controls the die block 1B and punch 1A. In the implementation shown in FIGS. 2 and 3, the control unit 5 controls the lift mechanism 8 for the die block 1B to control relative movement of the die block 1B and punch 1A. The control unit 5 supplies the lift mechanisms (i.e., actuators) 8 and 7 with control signals to control such driving.

The first press device 10 press forms the metal sheet B by positioning the metal sheet B between the die block 1B and punch 1A and pushing the metal sheet B with both the die block 1B and punch 1A. The die block 1B has, in its interior, a recessed shape that corresponds to the shape of the product to be press shaped. The punch 1A has a protruding shape that corresponds to the recessed shape of the die block 1B.

The surface of the die block 1B facing the punch 1A includes a pressing surface 1Bu that contacts and presses the metal sheet B. The die block 1B includes recessed portions, i.e., clearance portions 1Bc, in the surface thereof that faces the punch 1A. The clearance portions 1Bc do not abut the metal sheet B even when the die is at the bottom-dead center. That is, when the die is at the bottom-dead center, the clearance portions 1Bc form a clearance with the metal sheet B. A portion of the surface of the metal sheet B held by the die at the bottom-dead center that corresponds to each clearance portion 1Bc constitutes a non-abutment region.

The surface of the punch 1A facing the die block 1B includes a pressing surface 1Au that contacts and presses the metal sheet B. The punch 1A includes clearance portions 1Ac positioned to face the clearance portions 1Bc of the die block 1B. Each clearance portion 1Bc of the die block 1B and the associated clearance portion 1Ac of the punch 1A are positioned to face each other. As viewed in the direction of pressing, at least part of the clearance portion 1Ac of the punch 1A overlaps the clearance portion 1Bc of the die block 1B.

As shown in FIG. 3, when the die is at the bottom-dead center, the surfaces of the metal sheet B abut the pressing surface 1Bu of the die block 1B and the pressing surface 1Au of the punch 1A. At the clearance portions 1Bc and 1Ac, the surfaces of the metal sheet B do not abut the die. A portion of a surface of the metal sheet B that corresponds to a clearance portion 1Bc, 1Ac constitutes a non-abutment region Bc. In the implementation shown in FIG. 3, the clearance portions 1Bc and 1Ac are positioned to face each other, and thus non-abutment regions Bc are produced in the opposite regions of both sides of the metal sheet B.

Beginning with a state where the heated metal sheet B is positioned between the die block 1B and punch 1A as separated from each other, the control unit 5 causes the die block 1B and punch 1A to move closer to each other in the direction of pressing until they reach the bottom-dead center. The metal sheet B is thus press formed. Thereafter, the control unit 5 holds the die block 1B and punch 1A at the bottom-dead center. Thus, during the bottom-dead-center holding period of the first press device 10, the portions of the formed metal sheet B that are in contact with the die block 1B and punch 1A are rapidly cooled and hardened. The non-abutment regions Bc of the metal sheet B at the clearance portions 1Bc and 1Ac are gradually cooled.

In the implementation shown in FIG. 2, each of the die parts 1A and 1B of the first press device 10 includes a tube 11 that works as a channel for allowing a cooling medium to pass therethrough. The tube 11 exemplifies the cooling device. The tube 11 is constituted by, for example, a through-hole in the die part 1A, 1B. The amount of cooling medium flowing through the tube 11 is controlled by a valve 21, for example. The channel is not limited to a tube 11, and may be a groove in the surface of the die part 1A, 1B, for example. The cooling medium flowing through the channel cools the die part 1A, 1B. Such cooling keeps the die part 1A, 1B not higher than the Mf point (about 300° C.), for example. The cooling devices are not shown in the other drawings showing the die parts 1A and 1B.

Exemplary Construction of Second Press Device

Figure 4:
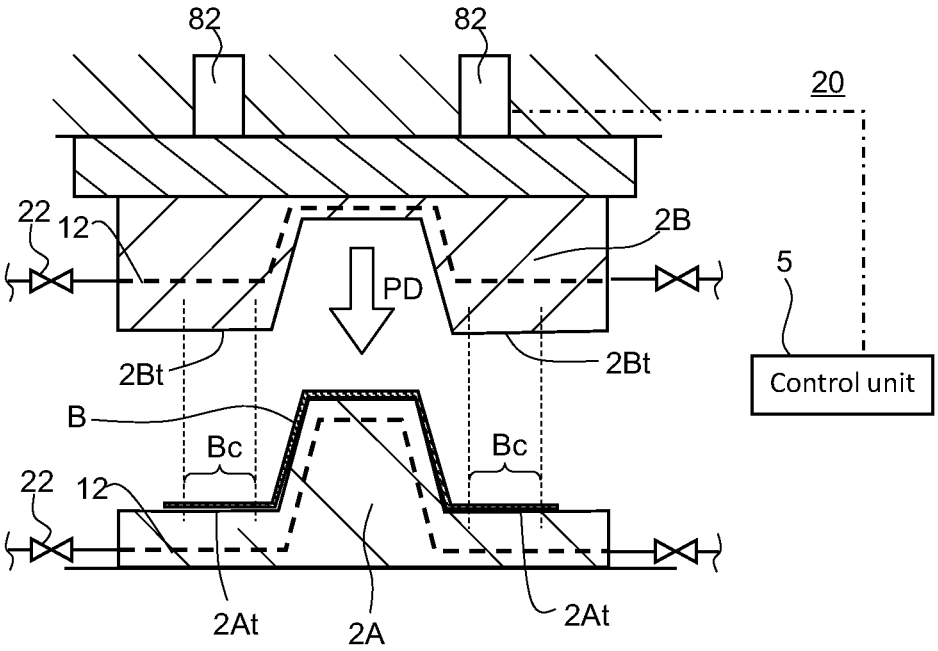
FIG. 4 is a cross-sectional view of a second press device according to an embodiment, illustrating its construction.
Figure 5:
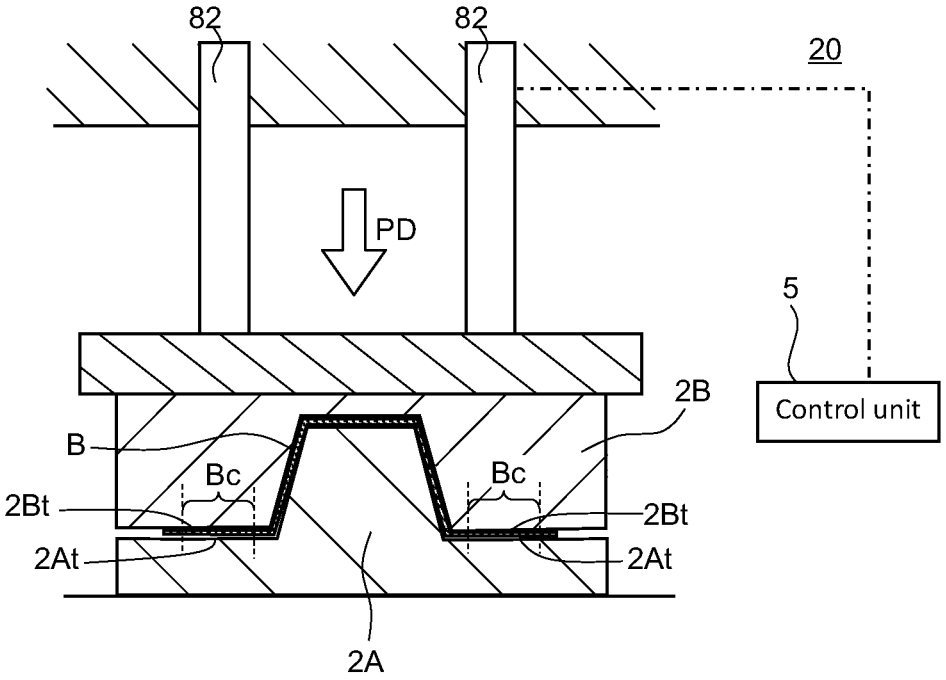
FIG. 5 shows the second press device shown in FIG. 4 as being at its bottom-dead center.

FIG. 4 is a cross-sectional view of the second press device 20 shown in FIG. 1, illustrating its construction. FIG. 5 illustrates the second press device 20 shown in FIG. 4 as being at its bottom-dead center. In the implementation shown in FIGS. 4 and 5, the second press device 20 includes a die block 2Bdie block 2B and a punch 2A that exemplify the pair of second die parts 2A and 2B. The die block 2Bdie block 2B is movable relative to the punch 2A in the direction of pressing PD.

The die block 2B has the same shape as the die block 1B of the first press device 10 except for the clearance portions 1Bc. The punch 2A has the same shape as the punch 1A of the first press device 10 except for the clearance portions 1Ac. The lift mechanism (i.e., actuator) 82 that moves the die block 2B and punch 2A relative to each other and the control unit 5 may have the same configurations as those of the first press device 10.

The surface of the die block 2B facing the punch 2A includes a pressing surface that contacts and presses the metal sheet B. The pressing surface of the die block 2B includes abutment surfaces 2Bt that correspond to the clearance portions 1Bc of the first press device 10. The abutment surfaces 2Bt abut the metal sheet B when the die is at the bottom-dead center. That is, when the die is at the bottom-dead center, the non-abutment regions Bc of the metal sheet B are positioned at those locations on the die block 2B of the second press device 20 which correspond to the clearance portions 1Bc.

The surface of the punch 2A facing the die block 2B includes a pressing surface that contacts and presses the metal sheet B. The pressing surface of the punch 2A includes abutment surfaces 2At that correspond to the clearance portions 1Ac of the first press device 10. The abutment surfaces 2At abut the metal sheet B when the die is at the bottom-dead center. When the die is at the bottom-dead center, the non-abutment regions Bc of the metal sheet B are positioned at those locations on the punch 2A of the second press device 20 which correspond to the clearance portions 1Ac.

As shown in FIG. 5, when the die is at the bottom-dead center, the surfaces of the metal sheet B abut the pressing surface of the die block 2B and the pressing surface of the punch 2A. The pressing surfaces also include the abutment surfaces 2Bt and 2At corresponding to the clearance portions 1Bc and 1Ac. The non-abutment regions Bc of the metal sheet B, which did not abut the die in the first press device 10 at the bottom-dead center, are now abutted by the die block 2B and punch 2A. In the implementation shown in FIG. 5, the die, i.e., die block 2B and punch 2A, abuts both non-abutment regions of the metal sheet B in the opposite regions of both sides.

Beginning with a state where the metal sheet B formed by the first press device 10 is positioned between the die block 2B and punch 2A as separated from each other, the control unit 5 causes the die block 2B and punch 2A to move closer to each other in the direction of pressing until they reach the bottom-dead center. Thereafter, the control unit 5 holds the die block 2B and punch 2A at the bottom-dead center. Thus, during the bottom-dead-center holding period of the second press device 20, the portions of the formed metal sheet B that are in contact with the die block 2B and punch 2A are rapidly cooled and hardened.

In the implementation shown in FIG. 4, each of the die parts 2A and 2B of the second press device 20 includes a tube 12 that works as a channel for allowing a cooling medium to pass therethrough. The tube 12 exemplifies the cooling device. The tube 12 is constituted by, for example, a through-hole in the die part 2A, 2B. The amount of cooling medium flowing through the tube 12 is controlled by a valve 22, for example. The channel is not limited to a tube 22, and may be a groove in the surface of the die part 2A, 2B, for example. The cooling medium flowing through the channel cools the die part 2A, 2B. Such cooling keeps the die part 2A, 2B not higher than the Mf point (about 300° C.), for example. The cooling devices are not shown in the other drawings showing the die parts 2A and 2B.

In the implementation shown in FIGS. 2 to 5, the metal sheet B, having an as-formed shape, is gripped by a die and cooled in the sum of the bottom-dead-center holding period of the first press device 10 (hereinafter referred to as first bottom-dead-center holding period) and the bottom-dead-center holding period of the second press device 20 (hereinafter referred to as second bottom-dead-center holding period), i.e., total bottom-dead-center holding period. In the total bottom-dead-center holding period, the portions of the of the metal sheet B that correspond to the clearance portions 1Ac and 1Bc, i.e., non-abutment regions Bc, experience a non-abutment period and an abutment period. Thus, the metal sheet B is locally gradually cooled, that is, the portions defined by the non-abutment regions Bc are gradually cooled and have different cooling conditions from those of the other portions. Thus, the properties of the portions of the metal sheet B defined by the non-abutment regions Bc are different from the properties of the other portions. Further, for the portions of the metal sheet B defined by the non-abutment regions Bc, the total bottom-dead-center holding period includes a non-abutment period with gradual cooling and an abutment period with rapid cooling; as such, while these portions are gradually cooled, their temperature decreases to some degree as they are gripped by the die. This reduces the difference between the temperature of the portions defined by the non-abutment regions Bc and those of the other portions i.e. portions that abut a die and are rapidly cooled in the total bottom-dead-center holding period. This makes it easier to ensure shape accuracy.

Exemplary Manufacturing Process

Now, an exemplary process of manufacturing a hot press-formed product using the hot press line 100 will be described. First, a material, i.e., a metal sheet B, is heated by the heating device 30. The metal sheet B may be, for example, a flat sheet, or may be an intermediate formed product that has been press formed. By way of example, the metal sheet B is a steel sheet. At the heating step, the metal sheet B is heated to the Ac3 point or above to austenitize the metallic microstructure. The heated metal sheet B is transported by the first transportation device 41 and positioned between the die block 1B and punch 1A of the first press device 10.

In the first press device 10, the heated metal sheet B is positioned between the die block 1B and punch 1A, and at least one of the die block 1B and punch 1A is moved to the bottom-dead center. The metal sheet B is thus hot press formed. The formed metal sheet B is held between the die block 1B and punch 1A at the bottom-dead center. During this first bottom-dead-center holding period, the metal sheet B in contact with the die block 1B and punch 1A is rapidly cooled. Some portions of the die of the first press device 10 provide clearance portions, constituted by clearance portions 1Bc recessed in the die block 1B and clearance portions 1Ac recessed in the punch 1A. When the die is at the bottom-dead center, the metal sheet B does not abut the clearance portions 1Ac and 1Bc. Thus, the portions of the metal sheet B corresponding to the clearance portions 1Ac and 1Bc, i.e., the portions defined by the non-abutment regions Bc, are cooled at a lower rate than the portions that are in contact with the die block 1B and punch 1A. This achieves gradual cooling of some portions of the metal sheet B.

Upon completion of the first bottom-dead-center holding period, the formed metal sheet B is positioned by the second transportation device 42 between the die block 2B and punch 2A of the second press device 20. The second press device 20 moves at least one of the die block 2B and punch 2A to the bottom-dead center. The formed metal sheet B is held between the die block 2B and punch 2A at the bottom-dead center. The die block 2B and punch 2A have no clearance portions. Thus, both sides of the entire metal sheet B abut the die. During this second bottom-dead-center holding period, the metal sheet B in contact with the die block 2B and punch 2A are rapidly cooled.

The non-abutment regions Bc of the metal sheet B, which were gradually cooled in the first press device 10, now abut the second die parts of the second press device 20, i.e., die block 2B and punch 2A, during the second bottom-dead-center holding period. During the second bottom-dead-center holding period, the non-abutment regions Bc of the metal sheet B are rapidly cooled. This achieves a close-to-uniform temperature distribution of the metal sheet B upon completion of the second bottom-dead-center holding period.

Upon completion of the second bottom-dead-center holding period, the formed metal sheet B (i.e., formed product) is removed from the die (i.e., die block 2B and punch 2A). The formed product thus obtained has been provided with a strength distribution, and has good shape accuracy.

Details of the mechanism with which a strength distribution is provided are as follows: there are three types of cooling of portions of the metal sheet B being hot press formed by the first press device 10 that correspond to the clearance portions 1Bc and 1Ac of the first die parts (i.e., die block 1B and punch 1A), i.e., portions defined by the non-abutment regions Bc, namely: (1) heat conduction within the metal sheet B; (2) heat conduction from the metal sheet B to the atmosphere; and (3) radiation from the metal sheet B to the die. As such, the cooling rates at the clearance portions are lower than those from heat conduction from the metal sheet B to the die due to the sheet's abutment with the die. If the cooling rate from austenite is lower than the critical cooling rate which depends on the steel sheet serving as a material, diffusion transformation occurs within the steel, producing a soft metallic microstructure of ferrite and/or bainite, for example. On the other hand, the portions in contact with the die experience non-diffusion transformation, producing a hard metallic microstructure mainly composed of martensite. That is, reducing cooling rate for some portions of the metal sheet enables manufacturing of a press-formed product with some softened portions.

If there are large temperature differences within the formed metal sheet (i.e., formed product) when the formed product is removed from the die, thermal contraction may cause the formed product to deform, leading to defects of shape. In contrast, according to the present embodiment, the second die parts (i.e., die block 2B and punch 2A) abut the non-abutment regions Bc of the metal sheet B during the second bottom-dead-center holding period of the second press device 20. This results in a close-to-uniform temperature, rather than temperature differences, in the formed product upon completion of the second bottom-dead-center holding period. This makes it easier to ensure the shape accuracy of the entire formed product. Further, during the abutment period in the second bottom-dead-center holding period, the metal sheet is cooled while being gripped by the die. This makes it easier to ensure shape accuracy, due to the portions gripped by the die, than in arrangements where the metal sheet is not gripped throughout the bottom-dead-center holding period.

In the above-described implementation, some portions of a die are caused to be separated from the metal sheet B in an early stage of the total bottom-dead-center holding period, i.e., during the first bottom-dead-center holding period, to provide non-abutment regions and, thereafter, a die is caused to abut the non-abutment regions of the metal sheet B in a late stage of the total bottom-dead-center holding period, i.e., during the second bottom-dead-center holding period.

Figure 6:
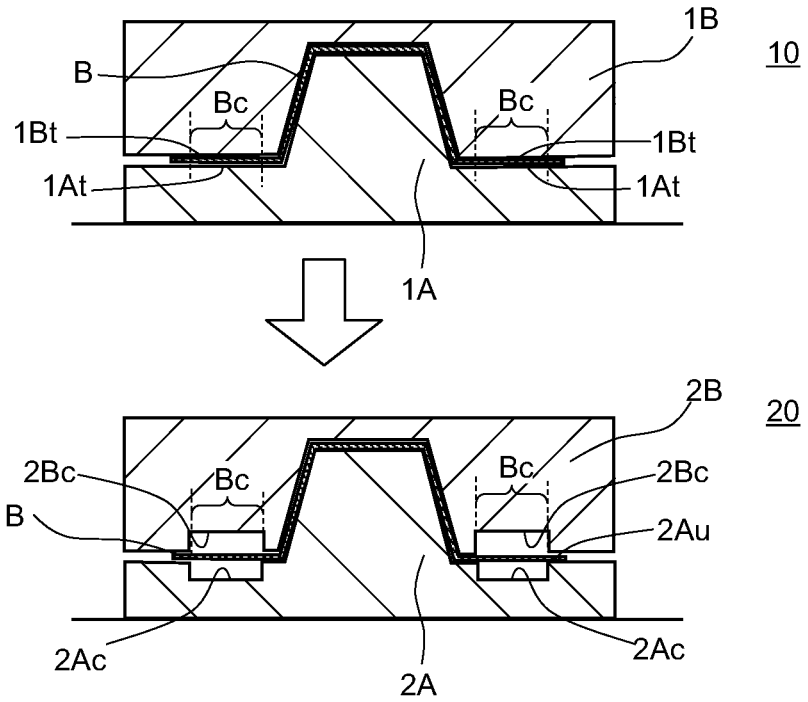
FIG. 6 shows a variation of the first and second die parts, modified in construction.

In the above-described implementation, the non-abutment regions of the metal sheet B do not abut a die in an early stage of the total bottom-dead-center holding period, and abut a die in a late stage. In other implementations, conversely, the non-abutment regions of the metal sheet B may abut a die in an early stage of the total bottom-dead-center holding period and not abut a die in a late stage. FIG. 6 shows such a variation of the first and second die parts, modified in construction. In the implementation shown in FIG. 6, the first die parts (i.e., die block 1B and punch 1A) of the first press device 10 have no clearance portions. The second die parts (i.e., die block 2B and punch 2A) of the second press device 20 include clearance portions 2Bc and 2Ac. The portions of the surfaces of the metal sheet B that do not abut a die when the second press device 20 is at the bottom-dead center, i.e., non-abutment regions Bc, abut the abutment surfaces 1At and 1Bt of the die when the first press direction 10 is at the bottom-dead center. That is, in the total bottom-dead-center holding period, the non-abutment regions Bc of the metal sheet B abut a die and are rapidly cooled during the first bottom-dead-center holding period, and the non-abutment regions Bc of the metal sheet B do not abut a die and are gradually cooled during the second bottom-dead-center holding period. In such implementations, too, the properties of the portions of the formed metal sheet B defined by the non-abutment regions Bc are different from those of the other portions. Further, a close-to-uniform temperature, rather than temperature differences, in the formed product results upon completion of the second bottom-dead-center holding period.

Figure 7:
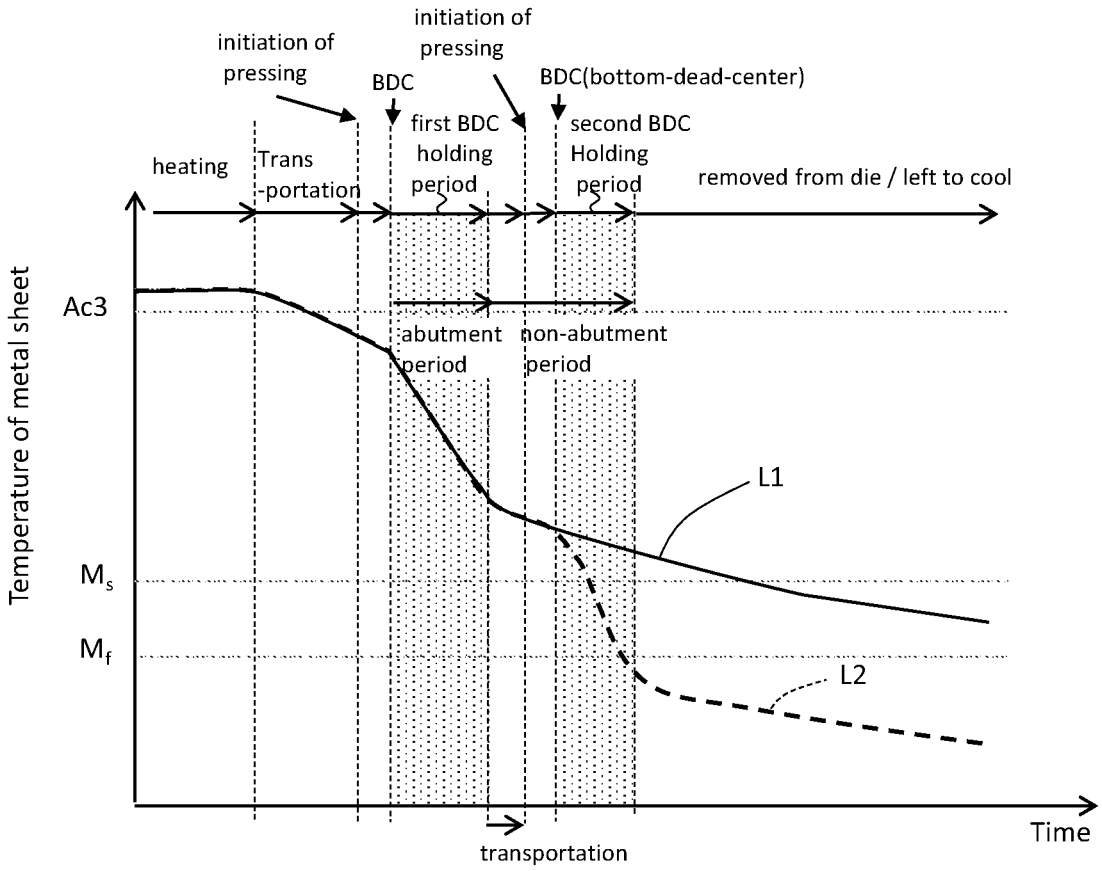
FIG. 7 is a graph illustrating an implementation where an abutment period is provided in the first bottom-dead-center holding period and a non-abutment period is provided in the second bottom-dead-center holding period.

FIG. 7 is a graph illustrating an implementation where an abutment period is provided in the first bottom-dead-center holding period and a non-abutment period is provided in the second bottom-dead-center holding period. FIG. 7 illustrates an exemplary implementation where press forming is performed by the first die parts and, then, by the second die parts, both shown in FIG. 6. In FIG. 7, line L1 indicates the temperature of the portions of the metal sheet B being press formed that correspond to the clearance portions. Line L2 indicates the temperature of the portions of the metal sheet B that abut a die throughout the bottom-dead-center holding period (i.e., other portions).

In the implementation shown in FIG. 7, from the beginning of the first bottom-dead-center holding period, the first die parts which have no clearance portions abut the metal sheet B. At this time, the clearance CL between the die and the metal sheet B is 0 mm. During the first bottom-dead-center holding period, the metal sheet B is rapidly cooled. Upon completion of the first bottom-dead-center holding period, the metal sheet B is removed from the first die, transported, and then positioned between the second die parts. The second die parts press form the metal sheet B and, after reaching the bottom-dead center, hold the metal sheet B while being at the bottom-dead center. The second die parts include clearance portions. When the die is at the bottom-dead center, the portions of the metal sheet B that correspond to the clearance portions of the second die parts do not abut the die. That is, the portions of the metal sheet B that correspond to the clearance portions are separated from the second die parts during the second bottom-dead-center holding period, and remain separated even at the end of the second bottom-dead-center holding period. Thus, the portions of the metal sheet B corresponding to the clearance portions, i.e., portions defined by the non-abutment regions, do not abut a die after completion of the first bottom-dead-center holding period i.e. abutment period. The period of time after the abutment period until the second die parts cease to be at the bottom-dead center constitutes the non-abutment period. During the second bottom-dead-center holding period, the portions of the metal sheet B defined by the non-abutment regions experience a lower cooling rate than the other portions, and are gradually cooled.

Thus, the first and second bottom-dead-center holding periods include an abutment period with rapid cooling and a non-abutment period with gradual cooling of some portions of the metal sheet. This reduces the difference between the temperature of the gradually cooled portions of the metal sheet B and that of the other portions. This makes it easier to ensure the shape accuracy of the entire formed product. Further, since the gradually cooled portions are gripped by a die during the first bottom-dead-center holding period, it is easier to ensure the shape accuracy of the gradually cooled portions.

In the implementation shown in FIG. 7, during the first bottom-dead-center holding period i.e. abutment period, the portions of the metal sheet B defined by the non-abutment regions are rapidly cooled, as indicated by line L1, and then separated from the first die parts before the Ms point (martensitic transformation starting point) is reached, and gradual cooling begins. Thereafter, the portions of the metal sheet B defined by the non-abutment regions abut no die and are thus gradually cooled during transportation, press forming by the second die parts and second bottom-dead-center holding. This produces a soft metallic microstructure. On the other hand, as indicated by line L2, the other portions of the metal sheet B other than the non-abutment regions Bc abut a die and are thus rapidly cooled during both the first and second bottom-dead-center holding periods. These other portions are cooled to the Mf point (martensitic transformation finishing point) and below during the second bottom-dead-center holding period. This produces a hard metallic microstructure mainly composed of martensite. Thus, the portions of the formed metal sheet B corresponding to the clearance portions, on the one hand, and the other portions, on the other, have different properties (i.e., strengths in the present implementation).

In the implementation of FIG. 7, the portions of interest of the metal sheet B are in the abutment period and thus rapidly cooled during the first bottom-dead-center holding period, i.e., period where the temperature is relatively high. Since the metal sheet B is gripped by a die in a period where the metal sheet B has a high temperature and is soft, it is easier to ensure shape accuracy, due to the gripped portions.

Figure 8:
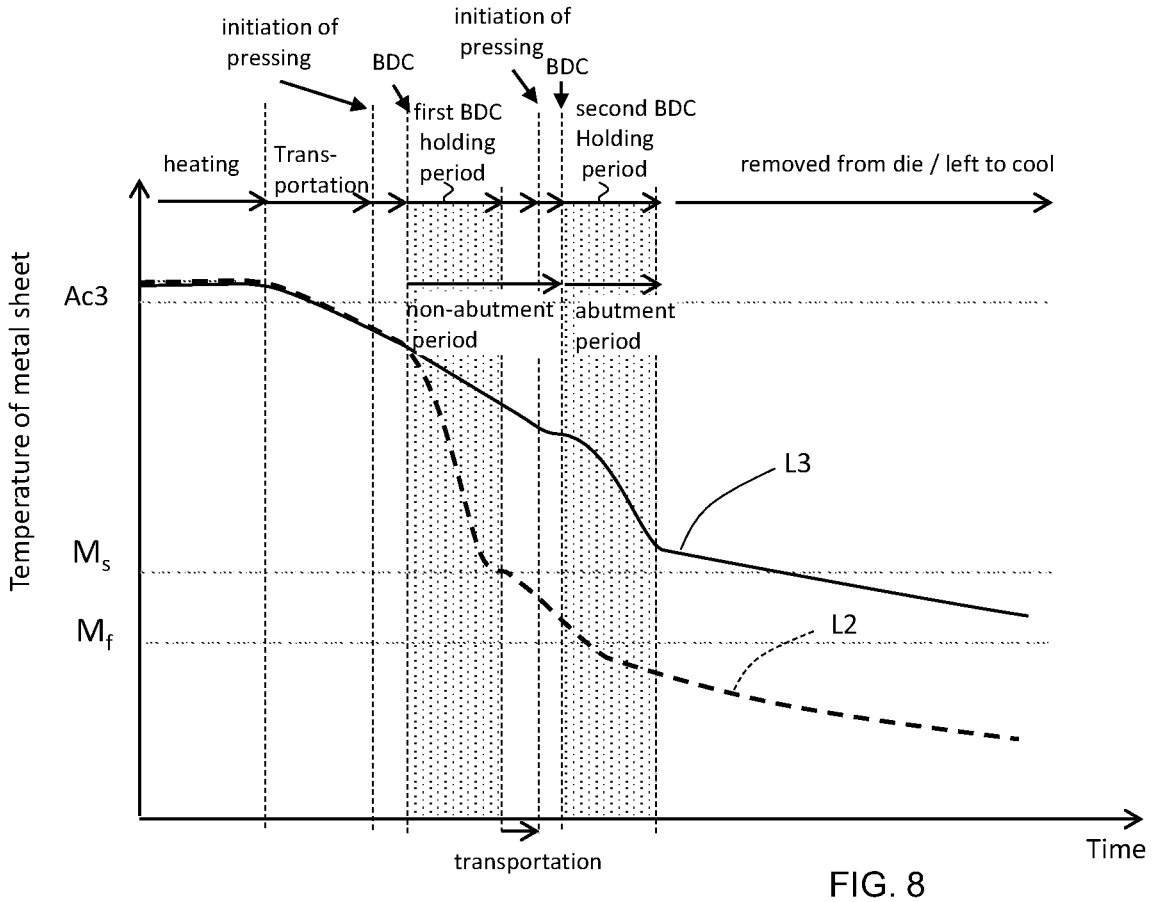
FIG. 8 is a graph illustrating an implementation where a non-abutment period is provided in the first bottom-dead-center holding period and an abutment period is provided in the second bottom-dead-center holding period.

FIG. 8 is a graph illustrating an implementation where a non-abutment period is provided in the first bottom-dead-center holding period and an abutment period is provided in the second bottom-dead-center holding period. FIG. 8 illustrates an implementation where press forming is performed by the first die parts shown in FIG. 2 and, then, the second die parts shown in FIG. 4. In FIG. 8, line L3 indicates the temperature of the portions of the metal sheet B being press formed that correspond to the clearance portions. Line L2 indicates the temperature of portions of the metal sheet B that abut a die throughout the bottom-dead-center holding period (i.e., other portions). In the implementation shown in FIG. 8, the first die parts include clearance portions. At the beginning of the first bottom-dead-center holding period, the clearance portions of the first die parts are separated from the metal sheet B. During the first bottom-dead-center holding period, the portions of the metal sheet B corresponding to the clearance portions, i.e., the portions defined by the non-abutment regions Bc, do not about the first die parts and are separated therefrom. Upon completion of the first bottom-dead-center holding period, the formed metal sheet B is removed from the first die parts, transported, and positioned between the second die parts. The second die parts press form the metal sheet B and, at the bottom-dead center, hold the sheet. During the second bottom-dead-center holding period, the portions of the metal sheet B corresponding to the clearance portions abut the second die parts. Thus, in the implementation shown in FIG. 8, there is a non-abutment period from the beginning of the first bottom-dead-center holding period. The transportation period is also part of the non-abutment period. The period of time from the beginning of the second bottom-dead-center holding period until the end of the second bottom-dead-center holding period constitutes the abutment period.

Thus, the first and second bottom-dead-center holding periods include a non-abutment period with gradual cooling and an abutment period with rapid cooling of some portions of the formed metal sheet B. This reduces the difference between the temperature of the gradually cooled portions of the metal sheet B and that of the other portions. This makes it easier to ensure the shape accuracy of the entire formed product. Further, since the gradually cooled portions are gripped by a die during the second bottom-dead-center holding period, it is easier to ensure the shape accuracy of the gradually cooled portions.

In the implementation shown in FIG. 8, for the portions of the metal sheet B of the non-abutment regions Bc, the abutment period, i.e., second bottom-dead-center holding period, ends before the temperature drops to the Ms point, as indicated by line L3. This produces a soft metallic microstructure. On the other hand, as indicated by line L2, the other portions of the metal sheet B other than the non-abutment regions Bc are rapidly cooled during the first and second bottom-dead-center holding periods, and thus cooled such that temperature drops to the Mf point or below at the end of the second bottom-dead-center holding period. This produces a hard metallic microstructure mainly composed of martensite. Thus, the portions of the formed metal sheet B corresponding to the clearance portions, on the one hand, and the other portions, on the other, have different properties (e.g., strengths).

In the implementation of FIG. 8, the portions of the metal sheet B corresponding to the clearance portions are in the abutment period and are rapidly cooled during the second bottom-dead-center holding period, i.e., a period where the temperature is relatively low and cooling rate has become low. In this implementation, the temperature difference caused by rapid cooling is small, making temperature control easier. Further, the metal sheet B is gripped and rapidly cooled when its temperature has decreased and the sheet has become somewhat hard, which makes it yet easier to ensure shape accuracy.

The abutment period and non-abutment period of the bottom-dead-center holding period are not limited to these exemplary implementations. For example, there may be two or more separate abutment periods in the bottom-dead-center holding period. By way of example, an abutment period may be provided in each of an early stage and a late stage of the bottom-dead-center holding period, and a non-abutment period may be provided in an intermediate period between the early and late stages. For example, after the first die parts having no clearance portions press form the sheet and hold it while being at the bottom-dead center, the second die parts having clearance portions may hold the sheet while being at the bottom-dead center and then, again, the first die parts (or third die parts with no clearance portions) may hold the sheet while being at the bottom-dead center.

Although not limiting, the length of the total bottom-dead-center holding period, i.e. sum of the first and second bottom-dead-center holding periods, may be 2 to 90 seconds, for example. The longer the total bottom-dead-center holding period, the better from the viewpoint of the uniformity of the temperature distribution of the formed product upon completion of the bottom-dead-center holding period; on the other hand, the shorter the bottom-dead-center holding period, the better from the viewpoint of manufacture efficiency. In view of this, a lower limit for the total bottom-dead-center holding period is preferably 10 seconds, and more preferably 15 seconds. An upper limit for the total bottom-dead-center holding period is preferably 90 seconds, and more preferably 30 seconds. In the present embodiment, the total bottom-dead-center holding period includes an abutment period and a non-abutment period; as such, a uniform temperature distribution in the formed product after completion of the total bottom-dead center holding period can easily be achieved even when the total bottom-dead-center holding period is not longer than 30 seconds, for example.

In the implementations shown in FIGS. 7 and 8, the portions of the sheet B other than the non-abutment region Bc are cooled to the Mf point and below in the total bottom-dead-center holding period. This enables quenching. All of the die parts 1A and 1B of the first press device 10 and the die parts 2A and 2B of the second press device 20 can be held at temperatures not higher than the Mf point by the cooling devices.

The clearance of the clearance portions 1Ac and 1Bc of the first die parts 1A and 1B, or the clearance portions 2Ac and 2Bc of the second die parts 2A and 2B, i.e., distance between a die and the metal sheet is not limited to any particular value; for example, it may be not smaller than 2 mm, preferably not smaller than 4 mm, and more preferably not smaller than 6 mm.

(Variations of Die Parts)

Figure 9:
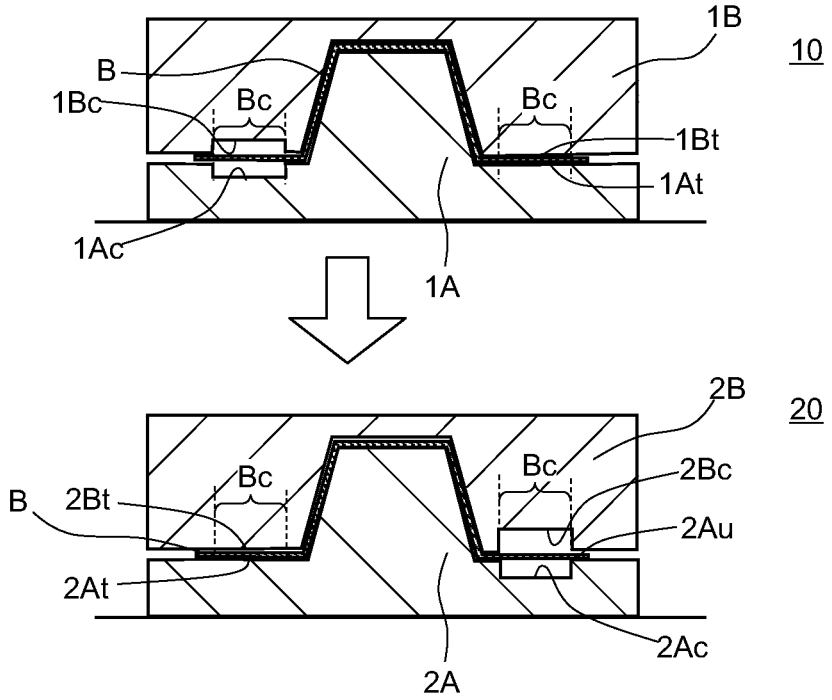
FIG. 9 shows a variation of the first and second die parts, modified in construction.

FIG. 9 shows a variation of the first and second die parts, modified in construction. In the implementation shown in FIG. 9, both the first die parts and the second die parts include clearance portions and abutment surfaces. A non-abutment region Bc of the metal sheet B corresponding to the pair of clearance portions 1Bc and 1Ac of the die block 1B and punch 1A constituting the first die parts is abutted by the abutment surfaces 2Bt and 2At of the die block 2B and punch 2A constituting the second die parts at the bottom-dead center. A non-abutment region Bc of the metal sheet B corresponding to the pair of clearance portions 2Ac and 2Bc constituting the second die parts is abutted by the abutment surfaces 1Bt and 1At of the die block 1B and punch 1A constituting the first die parts.

As shown in FIG. 9, at least part of the portions of the second die parts corresponding to the clearance portions of the first die parts may include abutment surfaces that abut the metal sheet while being at the bottom-dead center, and at least part of the portions of the first die parts corresponding to the clearance portions of the second die parts may include abutment surfaces that abut the metal sheet while being at the bottom-dead center. In this implementation, the metal sheet B includes both a portion that abuts a die during the first bottom-dead-center holding period and does not abut a die during the second bottom-dead-center holding period and a portion that does not abut a die during the first bottom-dead-center holding period and abuts a die during a second bottom-dead-center holding period.

Figure 10:
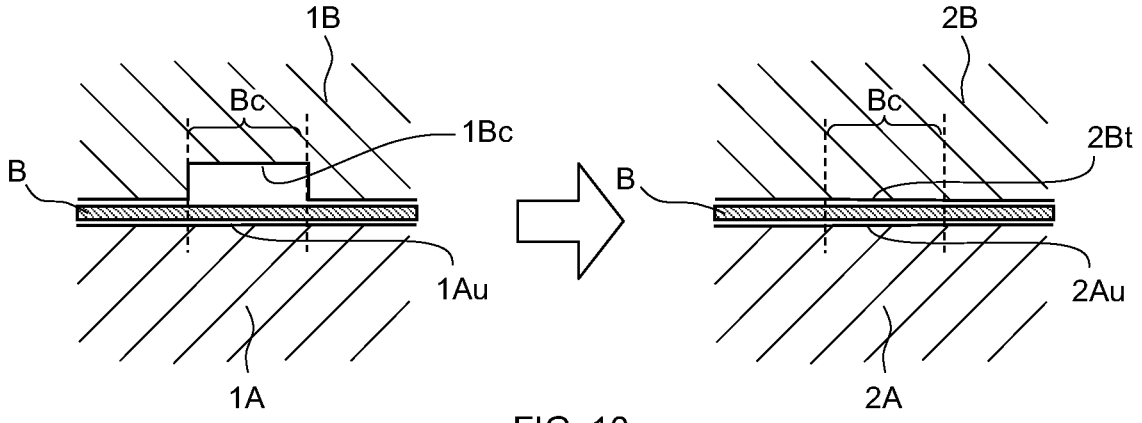
FIG. 10 shows a variation of the first and second die parts, modified in construction.

FIG. 10 shows another variation of the first and second die parts, modified in construction. In the implementation shown in FIG. 10, out of a pair of first die parts 1A and 1B, one die part 1B includes a clearance portion 1Bc constituted by a recess. The portion of the other die part 1A facing the clearance portion 1Bc has no clearance portion, i.e., recess, and is part of the pressing surface 1Au that abuts the metal sheet B. In this implementation, a non-abutment region Bc of the metal sheet B is created on the side associated with the clearance portion 1Bc, and the backside, i.e. side opposite to the non-abutment region Bc, has no non-abutment region Bc.

In the implementation of FIG. 10, the portion of the pair of the second die parts 2A and 2B corresponding to the clearance portion 1Bc of the first die part 1B, i.e., portion on which the non-abutment region Bc of the metal sheet B is positioned, represents an abutment surface 2Bt with which the second die part 2B abuts the metal sheet. Thus, a clearance portion, even if provided on one side only of the metal sheet B, produces the effect of ensuring the shape accuracy of a formed product provided with a property distribution. Starting from the implementation shown in FIG. 10, the first die parts and the second die parts may be reversed. That is, the second die parts may include a clearance portion on one side of the metal sheet B, whereas the first die parts may include an abutment surface at the position corresponding to the clearance portion of the second die parts.

Figure 11:
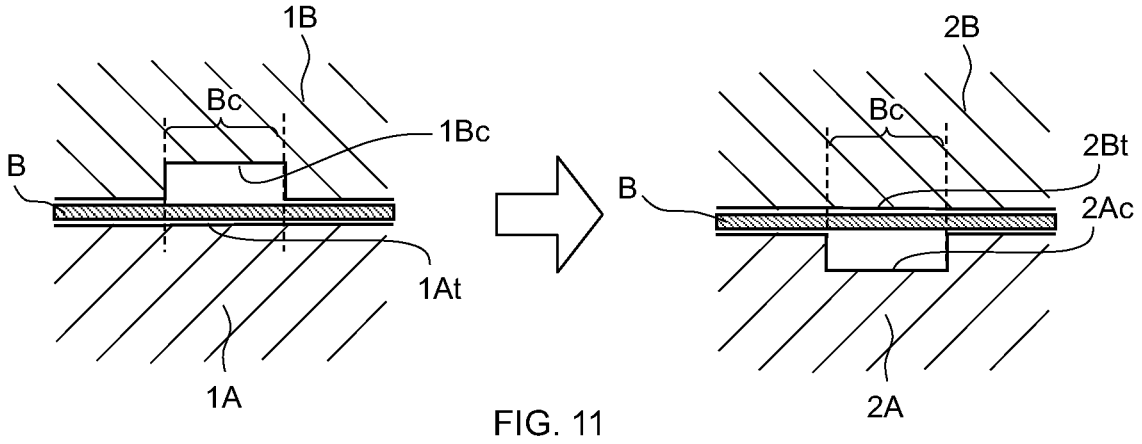
FIG. 11 shows a variation of the first and second die parts, modified in construction.

FIG. 11 shows yet another variation of the first and second die parts, modified in construction. In the implementation shown in FIG. 11, out of a pair of first die parts 1A and 1B, one die part 1B includes a clearance portion 1Bc constituted by a recess. The portion of the other die part 1A facing the clearance portion 1Bc has no clearance, i.e., recess, and abuts the metal sheet B. The portion of the second die part 2B corresponding to the clearance portion 1Bc of the first die part 1B represents an abutment surface 2Bt that abuts the metal sheet B. The portion of the second die part 2A facing the abutment surface 2Bt provides a clearance portion 2Ac constituted by a recess. The portion of the first die part 1A that corresponds to the clearance portion 2Ac of the second die part 2A represents an abutment surface 1At that abuts the metal sheet B. This construction also produces the effect of ensuring the shape accuracy of a formed product provided with a property distribution.

Figure 12:
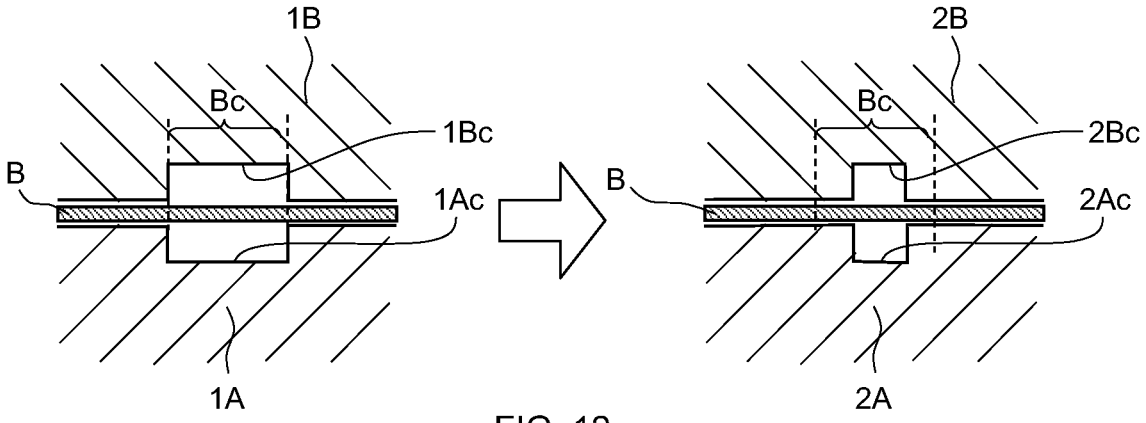
FIG. 12 shows a variation of the first and second die parts, modified in construction.

FIG. 12 shows still another variation of the first and second die parts, modified in construction. In the implementation shown in FIG. 12, the first die parts 1A and 1B include clearance portions 1Ac and 1Bc. In the second die parts 2A and 2B, part of each of the portions corresponding to the clearance portions 1Ac and 1Bc of the first die parts 1A and 1B provides a clearance portion 2Ac, 2Bc, and the other portions abut the metal sheet B. In other words, in the second die parts 2A and 2B, part of each of the portions on which the non-abutment region Bc of the metal sheet B is positioned represents an abutment surface, and the other portions provide clearance portions 2Ac and 2Bc. In this implementation, both the first die parts and second die parts include clearance portions. The clearance portions of the first die parts correspond in position to the clearance portions of the second die, but have a different surface area. Thus, cooling conditions can be set by modifying the areas of the clearance portions, for example.

Figure 13:
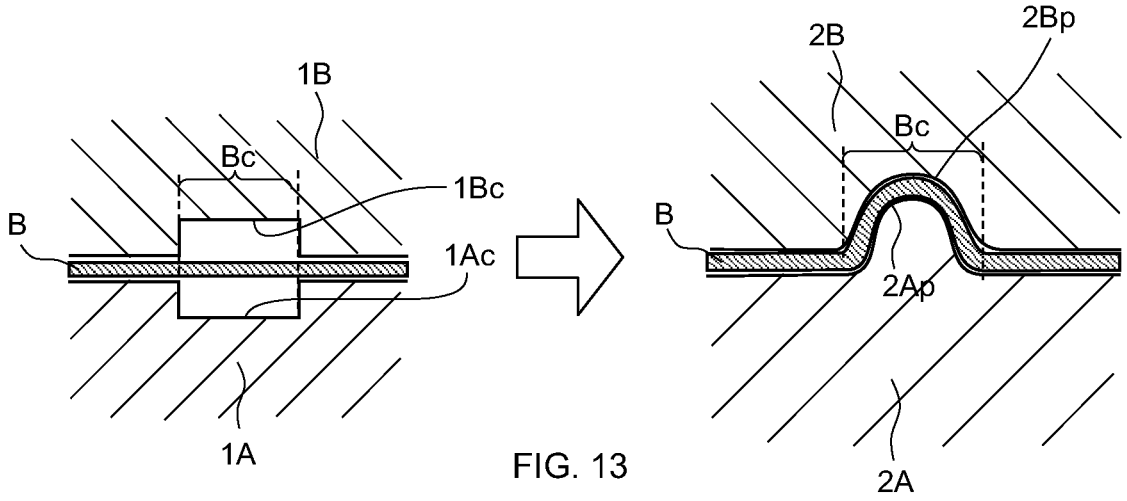
FIG. 13 shows a variation of the first and second die parts, modified in construction.

FIG. 13 shows yet another variation of the first and second die parts, modified in construction. In the implementation shown in FIG. 13, the first die parts 1A and 1B include clearance portions 1Ac and 1Bc. The portions of the second die parts 2A and 2B corresponding to the clearance portions 1Ac and 1Bc of the first die parts 1A and 1B represent a pair of abutment surfaces 2Ap and 2Bp facing each other that abut both sides of the metal sheet B. The pair of abutment surfaces 2Ap and 2Bp are shaped to bend the metal sheet B in the direction of pressing. One of the abutment surfaces, 2Ap, has a protruding shape, and the other has a recessed shape corresponding to the protruding shape. Thus, if each of the abutment surfaces 2Ap and 2Bp of the second die parts 2A and 2B has a recessed/protruding shape protruding or recessed in the direction of pressing, it is possible to form the associated portion of the metal sheet B into a shape that corresponds to that recessed/protruding shape.

Although not limiting, the hot press line and the method of manufacturing the hot press-formed product according to the embodiments may be applied to, for example, manufacturing of structural members for vehicles. Structural members for vehicles are often required to be provided with a strength distribution and provide shape accuracy. The embodiments may suitably be applied to such structural members for vehicles. For example, the hot press line according to an embodiment may manufacture a structural member for a vehicle constituted by a hot press-formed product (i.e., hot-stamped member) having some portions, within a single part, that have been softened in order to reduce the weight of the vehicle or achieve high performance, for example. Examples of such structural members for vehicles include high-strength center pillars having soft flanges or rear side members or bumper beams in which softened portions are positioned so as to control sharp-bend mode upon an impact.

EXAMPLES

B-pillar dies having clearance portions (hereinafter referred to as clearance dies) and dies having no clearance portions, i.e., clearance-less dies, were fabricated and tested. A clearance-less die is an example of a pair of first die parts, and had the same construction as the first die parts 1A and 1B shown in FIG. 6. A clearance die is an example of a pair of second die parts, and had the same construction as the second die parts 2A and 2B shown in FIG. 6. The first die parts had no clearance portions. The second die parts had clearance portions at positions corresponding to the flanges of the B-pillar. A clearance portion of the second die parts included a recessed portion (i.e., gap) 2Bc in the die block 2B and a recessed portion 2Ac in the punch 2A, facing that recessed portion. The portions of the metal sheet B corresponding to the clearance portions of the second die parts were not cooled by the die at the bottom-dead center and were thus gradually cooled, producing a soft metallic microstructure.

For the testing, the metal sheet used was a hot-rolled sheet to be hot stamped (hereinafter HS) (thickness: 2.6 mm). The metal sheet was heated for 5 minutes in a furnace set to 900° C., and formed by the first die parts and/or second die parts, held while the die was at the bottom-dead center, removed from the die, and left to cool. The three sets of clearance conditions applied while the sheet was held by the first die parts and/or second die parts at the bottom-dead center, i.e., condition sets (a) to (c) shown in Table 1 below, were used.

TABLE 1

| | | | |
|---|---|---|---|
| (a) | Clearance-less die (one step) | first die | without clearance (0 mm) |
| (b) | Clearance die (one step) | second die | with clearance (13 mm) |
| (c) | Clearance dies (two steps) | first and second dies | without clearance (0 mm) and with clearance (13 mm) |

In Table 1, condition set (a) means that a die without a clearance was used for press forming, and represents typical HS conditions, where the entire surface of the metal sheet including the flanges are in contact with the first die parts. In condition set (a), the metal sheet was transported to the first die after heating, held by the die parts at the bottom-dead center for 10 seconds, and then removed from the die and left to cool. Condition set (b) means that second die parts having clearance portions at positions corresponding to the flanges were used to press forming. In condition set (b), the metal sheet was transported to the second die parts after heating, held by the die at the bottom-dead center for 10 seconds, and then removed from the die and left to cool. The amount of clearance was constant throughout the bottom-dead-center holding period. Upon completion of the bottom-dead-center holding period, the sheet was removed from the die while the portions corresponding to the flanges were still at high temperatures. In condition set (c), the metal sheet was transported to the first die parts after heating, removed from the die immediately after the bottom-dead center was reached, transported to the second die parts, held by the die at the bottom-dead center for 30 seconds, and then removed from the die and left to cool.

Figure 14:
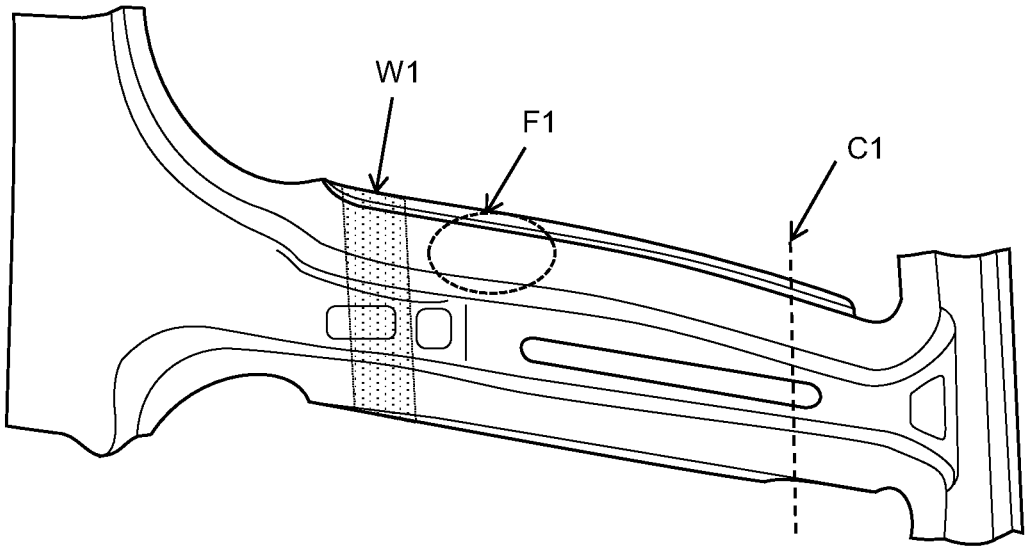
FIG. 14 shows the position on the formed product of an embodiment at which shape accuracy is evaluated.

The formed products after hot press forming were evaluated with respect to the hardness and shape accuracy of the flanges. Shape accuracy was evaluated based on the twisting of the formed product and the out-of-plane deformation of the flanges. The position on the formed product of an example at which shape accuracy was evaluated is shown in FIG. 14. The shape accuracy for each of condition sets (b) and (c) was evaluated with respect to the data from condition set (a).

Figure 15:
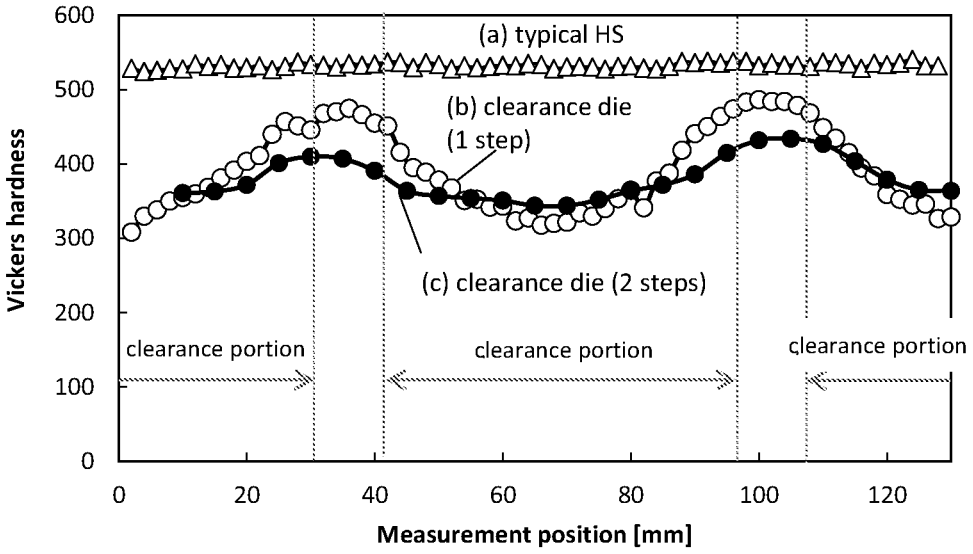
FIG. 15 is a graph showing the results of measurement of the hardness distributions of formed products.

FIG. 15 is a graph showing the results of measurement of the hardness distributions of the formed products. Compared with the formed product from condition set (a), the formed products from condition sets (b) and (c) had low hardnesses for the clearance portions. Clearance portion means a portion of the formed product corresponding to a clearance portion of a die. The results shown in FIG. 15 demonstrate the partial softening effect produced by the clearance portions of the clearance die with one step and the clearance dies with two steps.

Figure 16:
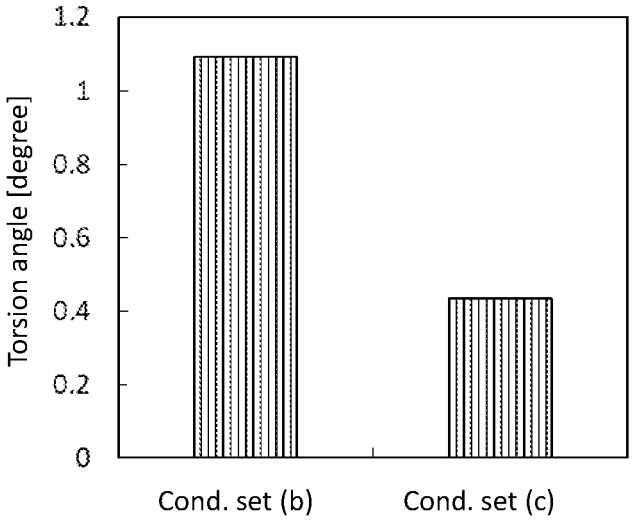
FIG. 16 is a graph showing the results of measurement of the torsion angles of formed products.

FIG. 16 is a graph showing the results of measurement of the torsion angles of the formed products. Torsion angle in the graph of FIG. 16 indicates to what degree the torsion-evaluation cross section Cl was twisted relative to that in the formed product from condition set (a), as found when the formed products from condition sets (a) to (c) were aligned in position with respect to the torsion-alignment surface W1 shown in FIG. 14.

The results shown in FIG. 16 demonstrate that the formed product formed by the clearance die of condition set (b) (with one step) had larger twisting, i.e., lower shape accuracy, than condition set (a) without a clearance. On the other hand, the formed product press formed by the clearance dies with two steps of condition set (c) had a torsion angle not higher than a half of that from condition set (b), demonstrating an improvement in shape accuracy.

Figure 17:
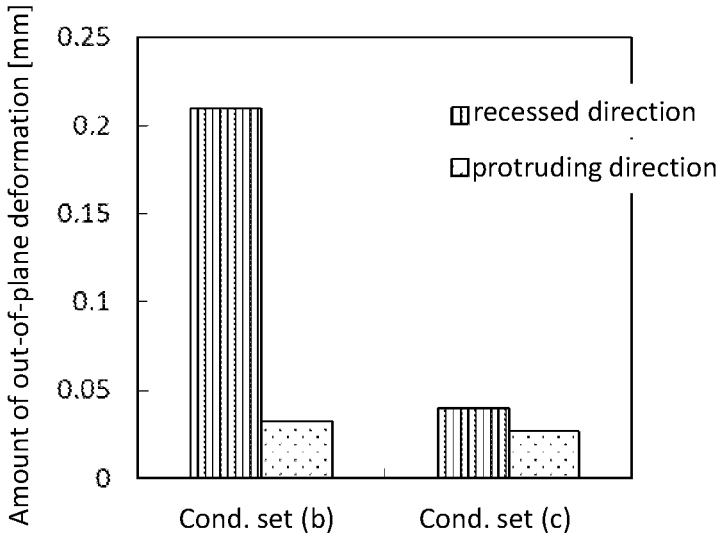
FIG. 17 is a graph showing the results of measurement of the out-of-plane deformations of formed products.

FIG. 17 is a graph showing the results of measurement of the out-of-plane deformations of the formed products. An amount of out-of-plane deformation shown in the graph of FIG. 17 indicates the amount of deformation of the surface at the out-of-plane deformation evaluation position F1 shown in FIG. 14 relative to that of the formed product from condition set (a). The out-of-plane deformation evaluation position F1 for condition sets (b) and (c) was a portion including a position on a flange corresponding to a clearance portion in a die. The examples shown in FIG. 17 demonstrate that the clearance dies with two steps from condition set (c) also improved local shape accuracy in the flanges corresponding to the clearance portions.

Although embodiments of the present invention have been described, the above-described embodiments are merely illustrative examples useful for carrying out the present invention. Thus, the present invention is not limited to the above-described embodiments, and the above-described embodiments, when carried out, may be modified as appropriate without departing from the spirit of the invention.

EXPLANATION OF CHARACTERS

1A, 1B: first die parts
1Ac, 1Bc: clearance portions
1At, 1Bt: abutment surfaces
10: first press device
100: hot press line
2A, 2B: second die parts
2Ac, 2Bc: clearance portions
2At, 2Bt: abutment surfaces
20: second press device
30: heating device
41: first transportation device
42: second transportation device
5: control unit
B: metal sheet
Bc: non-abutment regions

The invention claimed is:

1. A hot press line comprising:

a heating device adapted to heat a metal sheet;

a first press device including a pair of first die parts movable relative to each other in a direction of pressing and adapted to press form the heated metal sheet by moving the first die parts closer to each other in the direction of pressing and, at a bottom-dead center, hold the metal sheet;

a second press device including a pair of second die parts movable relative to each other in the direction of pressing and adapted, at a bottom-dead center of the second die parts, to hold the metal sheet press formed by the first press device;

a first transportation device adapted to transport the metal sheet from the heating device to the first press device; and a second transportation device adapted to transport the metal sheet from the first press device to the second press device, wherein at least one of the pair of first die parts and the pair of second die parts includes a clearance portion recessed inwardly to create a clearance with the metal sheet while the die parts are at the bottom-dead center, and other pair of the pair of first die parts and the pair of second die parts includes an abutment surface located in at least part of a portion corresponding to the clearance portion of the least one of the pair of first die parts and the pair of second die parts and adapted to abut the metal sheet while the die parts are at the bottom-dead center, and wherein the least one of the pair of the first die parts and the pair of second die parts is constructed to make a cooling rate in a non-abutment region of the metal sheet at the clearance portion lower than in a region of the metal sheet to be abutted by the least one of the pair of the first die parts and the pair of second die parts by only forming a clearance between the clearance portion and the non-abutment region when the least one of the pair of the first die parts and the pair of second die parts is at the bottom-dead center.

2. The hot press line according to claim 1, wherein the first die parts include the clearance portion, and the second die parts include the abutment surface in at least part of a portion corresponding to the clearance portion of the first die parts.

3. The hot press line according to claim 1, wherein the second die parts include the clearance portion, and the first die parts include the abutment surface in at least part of a portion corresponding to the clearance portion of the second die parts.

4. The hot press line according to claim 1, wherein the clearance portion of the least one of the pair of first die parts and the pair of second die parts includes a pair of clearance portions facing each other with the metal sheet positioned therebetween, and the abutment surface of the other pair of die parts includes a pair of abutment surfaces facing each other with the metal sheet positioned therebetween, the pair of abutment surfaces located in at least part of portions corresponding to the pair of clearance portions of the least one of the pair of first die parts and the pair of second die parts.

5. The hot press line according to claim 1, wherein the abutment surface of the other pair of die parts includes a pair of abutment surfaces facing each other in the direction of pressing, and the pair of abutment surfaces are shaped to bend the metal sheet in the direction of pressing.

6. A hot press line comprising:

a heating device adapted to heat a metal sheet;

a first press device including a pair of first die parts movable relative to each other in a direction of pressing and adapted to press form the heated metal sheet by moving the first die parts closer to each other in the direction of pressing and, at a bottom-dead center, hold the metal sheet;

a second press device including a pair of second die parts movable relative to each other in the direction of pressing and adapted, at a bottom-dead center of the second die parts, to hold the metal sheet press formed by the first press device;

a first transportation device adapted to transport the metal sheet from the heating device to the first press device; and a second transportation device adapted to transport the metal sheet from the first press device to the second press device, wherein at least one of the pair of first die parts and the pair of second die parts includes a clearance portion recessed inwardly to create a clearance with the metal sheet while the die parts are at the bottom-dead center, and other pair of the pair of first die parts and the pair of second die parts includes an abutment surface located in at least part of a portion corresponding to the clearance portion of the least one of the pair of first die parts and the pair of second die parts and adapted to abut the metal sheet while the die parts are at the bottom-dead center, and wherein a die portion of the least one of the pair of first die parts and the pair of second die parts facing the clearance portion of the one pair is provided with the abutment surface for abutting the metal sheet when the die parts are at the bottom-dead center, and a die portion of the other pair of die parts facing the abutment surface of the other pair is provided with the clearance portion recessed inwardly for creating a clearance with the metal sheet when the die parts are at the bottom-dead center.

7. A method of manufacturing a hot press-formed product, comprising:

heating a metal sheet;

positioning the heated metal sheet between a pair of first die parts of a first press device;

press forming the metal sheet by moving the first die parts closer to each other in a direction of pressing;

a first bottom-dead-center holding step for holding the metal sheet while the pair of first die parts are at a bottom-dead center;

after the first bottom-dead-center holding step, transporting the press-formed metal sheet to a pair of second die parts of a second press device and positioning the metal sheet therebetween; and a second bottom-dead center holding step for holding the metal sheet press formed by the first press device while the pair of second die parts are at a bottom-dead center, wherein, during one of the first bottom-dead-center holding step and the second bottom-dead-center holding step, a surface of the metal sheet has a non-abutment region that does not contact a die of one pair of first die parts or the pair of second die parts at a bottom-dead center, and at least part of the non-abutment region contacts a die of other pair of the pair of first die parts or the second die parts at a bottom-dead center during other bottom-dead-center holding step of the first bottom-dead-center holding step and the second bottom-dead-center holding step, and wherein during the one of the first bottom-dead-center holding step and the second bottom-dead-center holding step, a cooling rate in the non-abutment region is lower than in a region of the metal sheet to be abutted by the one pair of first die parts or the pair of second die parts by only forming a clearance between a clearance portion of at least one of the pair of first die parts and the pair of second die parts and the non-abutment region.

8. The method of manufacturing the hot press-formed product according to claim 7, wherein at least part of the non-abutment region of the metal sheet for the first bottom-dead-center holding step abuts at least one of the pair of second die parts during the second bottom-dead-center holding step.

9. The method of manufacturing the hot press-formed product according to claim 7, wherein at least part of the non-abutment region of the metal sheet for the second bottom-dead-center holding step abuts at least one of the pair of first die parts during the first bottom-dead-center holding step.

10. The method of manufacturing the hot press-formed product according to claim 7, wherein the non-abutment region of the metal sheet during the one bottom-dead-center holding step includes a pair of regions, facing each other, of both sides of the metal sheet, and at least part of each region of the pair of regions of the non-abutment region contacts the die of the other pair of the pair of first die parts or the second die parts at the bottom-dead center during the other bottom-dead-center holding step.

11. The method of manufacturing the hot press-formed product according to claim 7, wherein, during the other bottom-dead-center holding step, at least part of the non-abutment region of the metal sheet for the one bottom-dead-center holding step contacts the die of the other pair of the pair of first die parts or the second die parts at the bottom-dead center and is formed to bend in the direction of pressing.

12. A method of manufacturing a hot press-formed product, comprising:

heating a metal sheet;

positioning the heated metal sheet between a pair of first die parts of a first press device:

press forming the metal sheet by moving the first die parts closer to each other in a direction of pressing;

a first bottom-dead-center holding step for holding the metal sheet while the pair of first die parts are at a bottom-dead center;

after the first bottom-dead-center holding step, transporting the press-formed metal sheet to a pair of second die parts of a second press device and positioning the metal sheet therebetween; and a second bottom-dead center holding step for holding the metal sheet press formed by the first press device while the pair of second die parts are at a bottom-dead center, wherein, during one of the first bottom-dead-center holding step and the second bottom-dead-center holding step, a surface of the metal sheet has a non-abutment region that does not contact a die of one pair of first die parts or the pair of second die parts at a bottom-dead center, and at least part of the non-abutment region contacts a die of other pair of the pair of first die parts or the second die parts at a bottom-dead center during other bottom-dead-center holding step of the first bottom-dead-center holding step and the second bottom-dead-center holding step, and during the one bottom-dead-center holding step, at least part of a back side region of the metal sheet for the non-abutment region is abutted by a die part at the bottom-dead center, during the other bottom-dead-center holding step, and at least part of the back side region for the non-abutment region is not abutted by a die part.

* * * * *